US005648627A

United States Patent [19]

Usa

[11] Patent Number: 5,648,627

[45] Date of Patent: Jul. 15, 1997

[54] MUSICAL PERFORMANCE CONTROL APPARATUS FOR PROCESSING A USER'S SWING MOTION WITH FUZZY INFERENCE OR A NEURAL NETWORK

[75] Inventor: Satoshi Usa, Hamamatsu, Japan

[73] Assignee: Yamaha Corporation, Japan

[21] Appl. No.: 710,706

[22] Filed: Sep. 20, 1996

[30] Foreign Application Priority Data

Sep. 27, 1995 [JP] Japan ..... 7-273518
Oct. 2, 1995 [JP] Japan ..... 7-278327

[51] Int. Cl.[6] ..... G10H 7/00

[52] U.S. Cl. ..... 84/600; 84/652; 84/477 B; 84/484; 395/21; 395/900

[58] Field of Search ..... 84/600, 652, 477 B, 84/484, DIG. 12; 395/21, 900

[56] References Cited

U.S. PATENT DOCUMENTS 4,341,140 7/1982 Ishida .
5,047,701 9/1991 Takarada et al. .
5,138,924 8/1992 Ohya et al. .
5,138,928 8/1992 Nakajima et al. ..... 84/DIG. 12 X
5,292,995 3/1994 Usa ..... 395/900 X
5,369,217 11/1994 Yamashita et al. .

FOREIGN PATENT DOCUMENTS 56-162796 12/1981 Japan .
6-161440 6/1994 Japan .

*Primary Examiner*—David S. Martin
*Assistant Examiner*—Jeffrey W. Donels
*Attorney, Agent, or Firm*—Graham & James LLP

[57] ABSTRACT

A performance control apparatus is provided to control a manner of performance played by an electronic musical apparatus. Herein, sensors are provided to sense a swing motion of a baton which is swung by a human operator in response to time of music to be played (e.g., triple time). Then, a peak is detected from outputs of the sensors in accordance with a peak detection process using a fuzzy inference process. A kind of the swing motion is discriminated by effecting another fuzzy inference process on a result of the peak detection process. Concretely, the kind of the swing motion is discriminated as one of predetermined motions which are determined specifically with respect to time of the music. Performance control information is created based on the discriminated kind of the swing motion. Thus, a tempo and/or dynamics of performance is controlled in response to the performance control information. Incidentally, the fuzzy inference processes can be replaced by a neural network whose structure is determined in advance to calculate probabilities with respect to the swing motion so that the kind of the swing motion is discriminated. Moreover, the sensors can be constructed by angular velocity sensors, preferably piezoelectric-vibration gyro sensors, to detect angular velocities of the swing motion of the baton in axial directions.

16 Claims, 16 Drawing Sheets

MUSICAL PERFORMANCE CONTROL APPARATUS FOR PROCESSING A USER'S SWING MOTION WITH FUZZY INFERENCE OR A NEURAL NETWORK

BACKGROUND OF THE INVENTION

1. Field of the Invention

The invention relates to performance control apparatuses which control music performance of electronic musical apparatuses in response to a swing motion of a conducting baton.

2. Prior Art

The electronic musical apparatuses indicate electronic musical instruments, sequencers, automatic performance apparatuses, sound source modules and karaoke systems as well as personal computers, general-use computer systems, game devices and any other information processing apparatuses which are capable of processing music information in accordance with programs, algorithms and the like.

Conventionally, there are provided electronic musical apparatuses which are capable of controlling music performance in response to motions of a human operator. Herein, some apparatuses detect characteristic points, such as peak points, from an output waveform of a sensor which senses motions of the human operator. Other apparatuses are designed to discriminate kinds of the motions (e.g., swing-down motions). So, a variety of signal processing methods are used to enable such detection or such discrimination. As examples of the signal processing methods, there are provided filter processes (or averaging processes) and large/small comparison processes, for example.

In general, human motions are obscure and unstable. Therefore, the aforementioned signal processing methods which are relatively simple have a low precision in detection and discrimination. So, detection errors and discrimination errors may frequently occur. The conventional apparatuses control a tempo of automatic performance in response to a result of detection or a result of discrimination, for example. However, due to the reasons described above, such a tempo control suffers from a variety of disadvantages as follows:

(1) Much time is required for a user to be accustomed to system; or much time is required for the user to be familiar with operations of a machine.

(2) Due to occurrence of an operation error (i.e., error response which is different from an intended operation which the user intends to designate), reliability in controlling of music performance is relatively low; and it is difficult to ensure 'stable' music performance.

SUMMARY OF THE INVENTION

It is an object of the invention to provide a brand-new performance control apparatus which is capable of executing highly-reliable performance control in response to swing motions made by the human operator. Particularly, the invention is provided to achieve the highly-reliable performance control by employing an advanced computation method using a fuzzy inference process or a neural network.

A performance control apparatus of the invention is provided to control a manner of performance played by an electronic musical apparatus, for example. Herein, sensors are provided to sense a swing motion of a baton which is swung by a human operator in response to time of the music to be played. Then, a peak is detected from outputs of the sensors in accordance with a peak detection process using a fuzzy inference process. A kind of the swing motion is discriminated by effecting another fuzzy inference process on a result of the peak detection process. Concretely, the kind of the swing motions is discriminated as one of predetermined motions which are determined specifically with respect to time of the music. For example, three kinds of motions are set to triple time, whilst two kinds of motions are set to duple time or quadruple time.

Next, performance control information is created based on the discriminated kind of the swing motion. Thus, a tempo and/or dynamics of performance is controlled in response to the performance control information.

The fuzzy inference processes can be replaced by a neural network whose structure is determined in advance to calculate probabilities with respect to the swing motion so that the kind of the swing motion is discriminated. Moreover, the sensors can be constructed by angular sensors, preferably piezoelectric-vibration gyro sensors, to detect angular velocities of the swing motion of the baton in axial directions.

Thanks to usage of the fuzzy inference processes or neural network, a precision of discrimination is improved so that the kind of the swing motion is discriminated with accuracy. As a result, it is possible to execute performance control in a highly-reliable manner.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENTS

[A] System of Performance Control Apparatus

Figure 1:
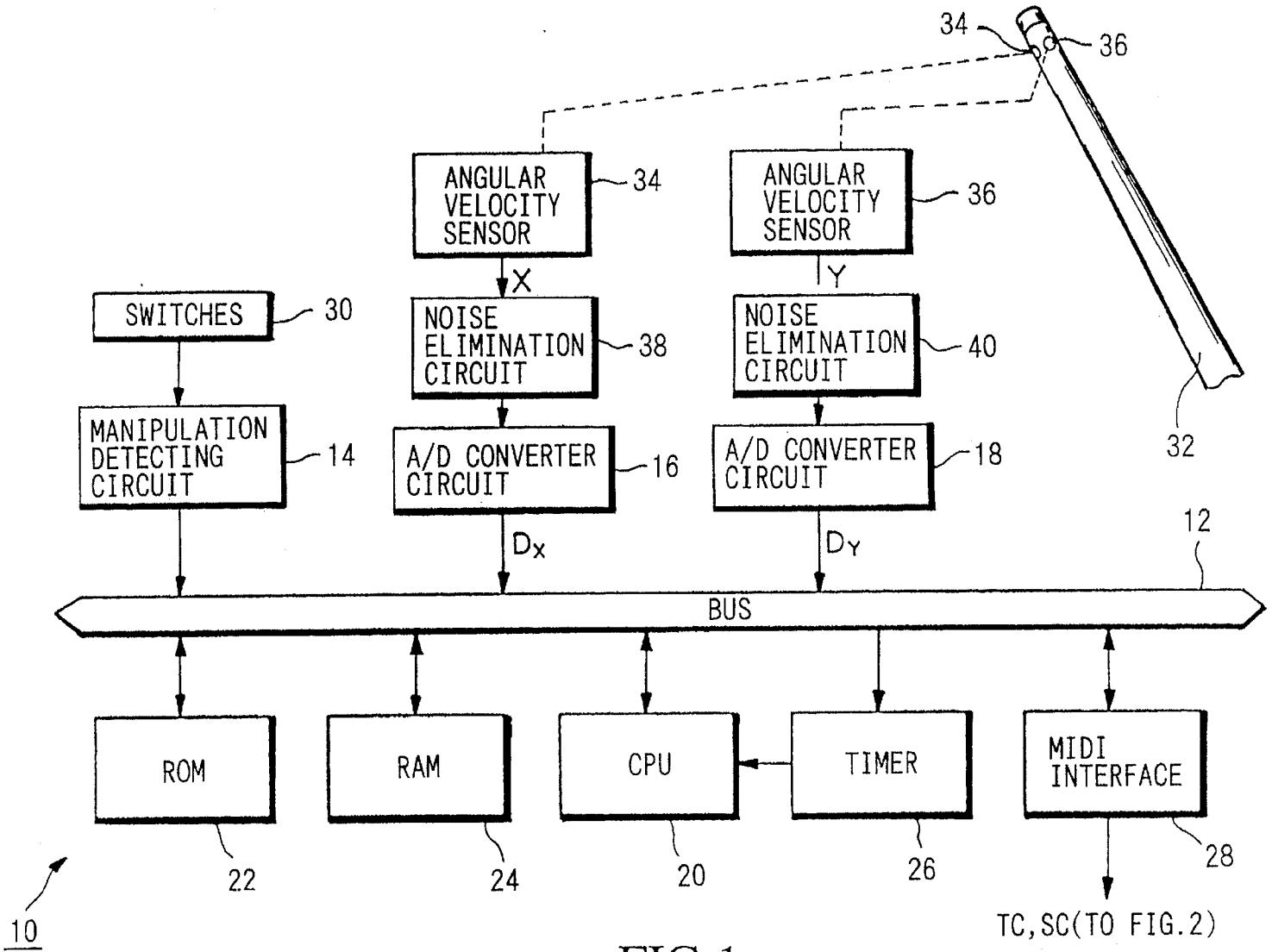
FIG. 1 is a block diagram showing a swing-motion analyzing device.
Figure 2:
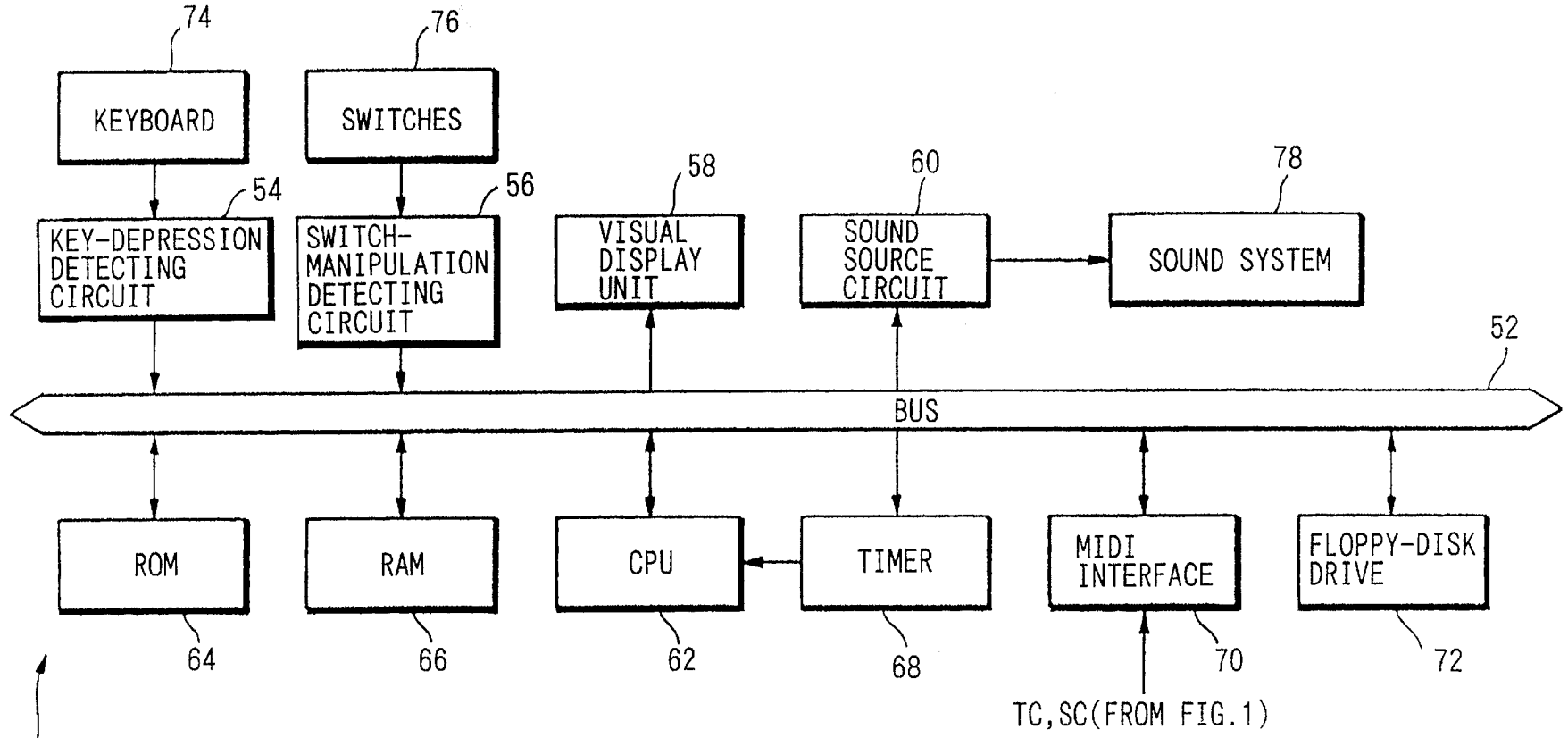
FIG. 2 is a block diagram showing an electronic musical apparatus which cooperates with the swing-motion analyzing device of FIG. 1 to realize functions of a performance control apparatus which is designed in accordance with an embodiment of the invention.

The performance control apparatus of the invention is embodied by an electronic musical apparatus 50 of FIG. 2 equipped with a swing-motion analyzing device 10 of FIG. 1. The swing-motion analyzing device 10 is used to control tempos and music characteristics (e.g., tone volume, tone color, etc.) of automatic performance played by the electronic musical apparatus 50.

In the swing-motion analyzing device 10 of FIG. 1, there are provided a manipulation detecting circuit 14, analog-to-digital converter circuits (i.e., A/D converter circuits) 16 and 18, a central processing unit (i.e., CPU) 20, a read-only memory (i.e., ROM) 22, a random-access memory (i.e., RAM) 24, a timer 26 and a MIDI interface 28, which are interconnected together by means of a bus 12. Incidentally, 'MIDI' is an abbreviation for the standard of 'Musical Instrument Digital Interface'.

The manipulation detecting circuit 14 detects manipulation information with respect to each of switches '30', which contain a performance-start switch, for example. The performance-start switch can be provided in the electronic musical apparatus 50. Or, the performance-start switch can be attached to a conducting baton (simply called a 'baton') 32 in proximity to its grip section. In such a case, a human operator who holds the baton 32 can manipulate the switch with ease.

Angular-velocity sensors 34 and 36 are attached to a tip-edge portion of the baton 32 to perform detection with respect to a x-direction and a y-direction (i.e., a horizontal direction and a vertical direction) respectively. For example, the angular-velocity sensors are made by piezoelectric-vibration gyro sensors. Outputs 'X' and 'Y' of the angular-velocity sensors 34 and 36 are respectively supplied to the A/D converter circuits 16 and 18 through noise elimination circuit 38 and 40 The output X of the angular-velocity sensor 34 is subjected to noise elimination by the noise elimination circuit 38, and is then converted to a digital output $D_X$ by the A/D converter circuit 16. Similarly, the output Y of the angular-velocity sensor 36 is subjected to noise elimination by the noise elimination circuit 40, and is then converted to a digital output $D_Y$ by the A/D converter circuit 18.

In accordance with programs stored in the ROM 22, the CPU 20 perform analysis on the digital outputs $D_X$ and $D_Y$ of the A/D converter circuits 16 and 18. Based on results of the analysis, the CPU 20 executes a variety of processes to produce tempo control information TC and musical-tone control information SC. Details of the processes will be described later in conjunction with several drawings containing FIGS. 3 to 5. In order to enable execution of the processes by the CPU 20, the RAM 24 provides storage areas which are used as registers and the like.

Figure 6:
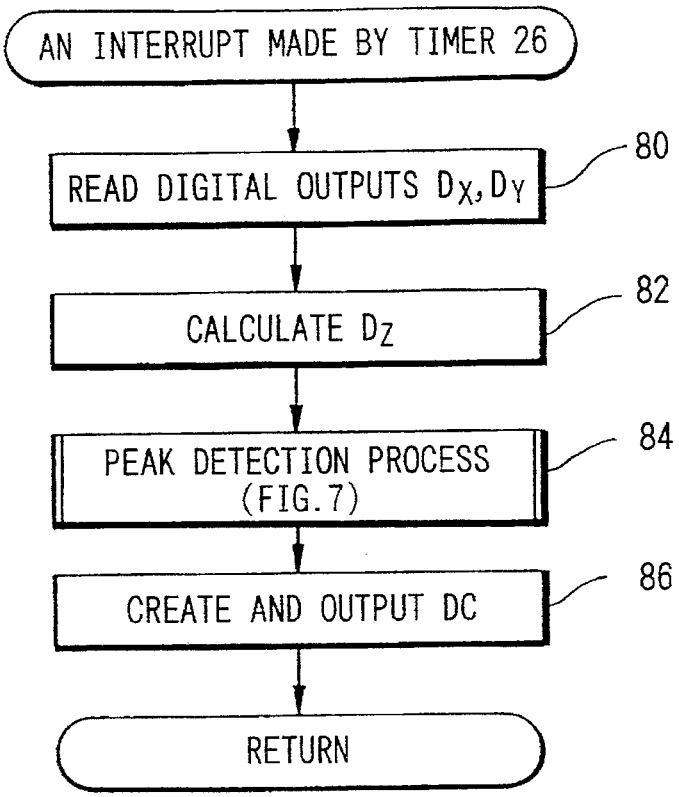
FIG. 6 is a flowchart showing a sensor output process which is designed to be suited for a fuzzy inference process in accordance with a first embodiment of the invention.
Figure 14:
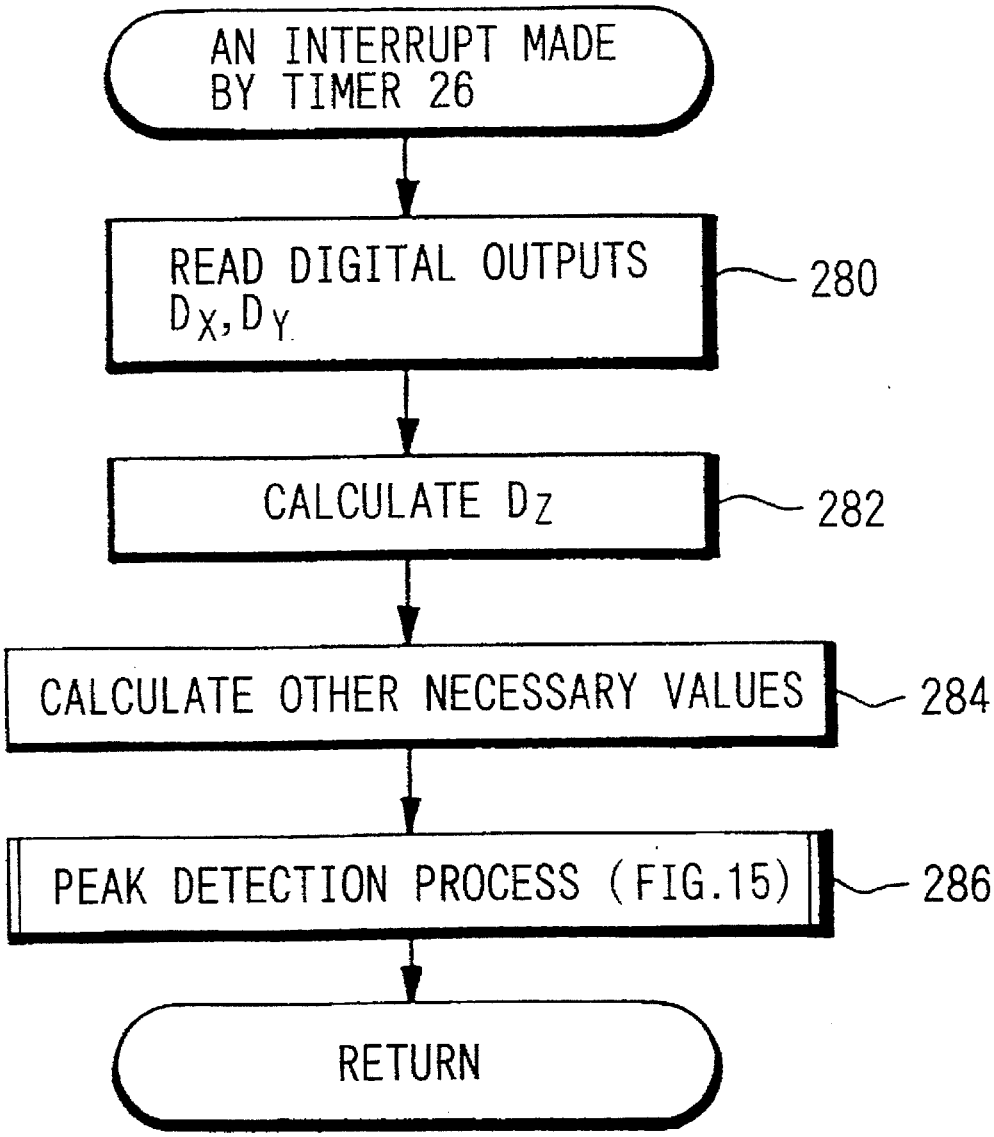
FIG. 14 is a flowchart showing a sensor output process which is used by the second embodiment.

The timer 26 is provided to supply interrupt instruction signals to the CPU 20. A period to generate an interrupt instruction signal is 10 ms, for example. Every time the timer 26 issues an interrupt instruction signal, the CPU 20 executes a sensor output process which is shown in FIG. 6 or FIG. 14.

The MIDI interface 28 in FIG. 1 is connected to a MIDI interface 70 in FIG. 2 by means of a MIDI cable (not shown). The MIDI interface 28 transmits the tempo control information TC and musical-tone control information SC to the MIDI interface 70.

Meanwhile, the electronic musical apparatus 50 of FIG. 2 provides a key-depression detecting circuit 54, a switch-manipulation detecting circuit 56, a visual display unit 58, a sound source circuit 60, a CPU 62, a ROM 64, a RAM 66, a timer 68, a floppy-disk drive 72 and the MIDI interface 70, all of which are interconnected together by a bus 52.

A keyboard 74 contains a plenty of keys each of which provides a key switch. So, the key-depression detecting circuit 54 scans states of the key switches so as to detect key manipulation information with respect to each key.

Switches 76 contain a performance-mode select switch. The switch-manipulation detecting circuit 56 detects switch manipulation information with respect to each of the switches 76. The electronic musical apparatus provides two modes, i.e., a manual-performance mode and an automatic-performance mode. By manipulating the performance-mode select switch, it is possible to select one of or both of the two modes.

The visual display unit 58 contains a display device (or indicators) which provides visual display of certain values set for the tempo, tone volume, etc.

The sound source circuit 60 has 15 channels, for example, which are denoted by 'channel 1' to 'channel 15' respectively. So, each channel is capable of generating a musical tone signal in response to event data. If event data regarding a key-on event are assigned to the channel 1, the channel 1 starts generation of a musical tone signal having a tone pitch and a tone volume which are designated by the event data supplied thereto. If event data regarding a key-off event are assigned to the channel 1, the channel 1 starts attenuation of a musical tone signal having a tone pitch which is designed by the event data supplied thereto. Similar operations to control generation of musical tone signals are made by the other channels.

As a result, the sound source circuit 60 generates one musical tone signal or multiple musical tone signals. The musical tone signal is converted to the acoustics by a sound system 78.

The CPU 62 controls generation of manual-performance sound signals and/or generation of automatic-performance sound signals. Herein, the manual-performance sound signals are generated in accordance with programs stored in the ROM 64 based on manipulation of the keyboard 74, whilst the automatic-performance sound signals are generated based on performance data stored in the RAM 66. Details of processes to generate the automatic-performance sound signals will be described later in conjunction with several drawings containing FIGS. 16 to 20. Incidentally, performance data of a desired tune, which are selectively read out from a floppy disk of the floppy disk drive 72, can be written into the RAM 66. Or, performance data of a desired tune can be selectively read out from the ROM 64. In addition, the RAM 66 contains storage areas which are used as registers and counters for the processes executed by the CPU 62.

The timer 68 issues interrupt instruction signals to the CPU 62. A period to generate an interrupt instruction signal is 1 ms, for example. Every time the timer 68 issues an interrupt instruction signal, the CPU 62 executes a playback process of FIG. 16. As a result, automatic performance is accomplished based on performance data stored in the RAM 66.

As described before, the MIDI interface 70 receives tempo control information TC and musical-tone control information SC which are outputted from the swing-motion analyzing device 10 of FIG. 1. So, the CPU 62 controls a tempo of automatic performance in response to the tempo control information TC; and the CPU 62 also controls music characteristics of automatic performance (e.g., tone volume and tone color) in response to the musical-tone control information SC.

Figure 3A:
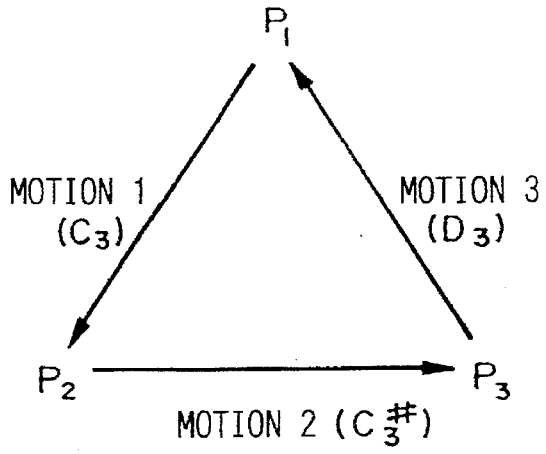
FIG. 3A shows a locus of a swing motion which is made by a human operator with respect to triple time.
Figure 3B:
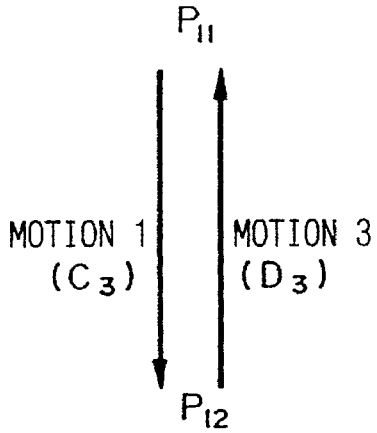
FIG. 3B shows a locus of a swing motion which is made by a human operator with respect to duple time or quadruple time.

FIG. 3A shows a locus of a swing motion of the baton 32 which is swung by a human operator with respect to triple time. FIG. 3B shows a locus of a swing motion of the baton 32 which is swung by the human operator with respect to duple time or quadruple time.

In case of triple time shown in FIG. 3A, the swing motion forms a triangle locus in which a swing direction changes at points $P_1$, $P_2$ and $P_3$ respectively. Herein, an absolute angular velocity $D_Z$ is given by an equation (1) as follows:

$$D_Z=\sqrt{(D_X^2+D_Y^2)}$$

where '$D_X$' and '$D_Y$' represent digital outputs of the A/D converter circuits 16 and 18 which correspond to outputs X and Y of the angular velocity sensors 34 and 36 respectively.

Figure 4:
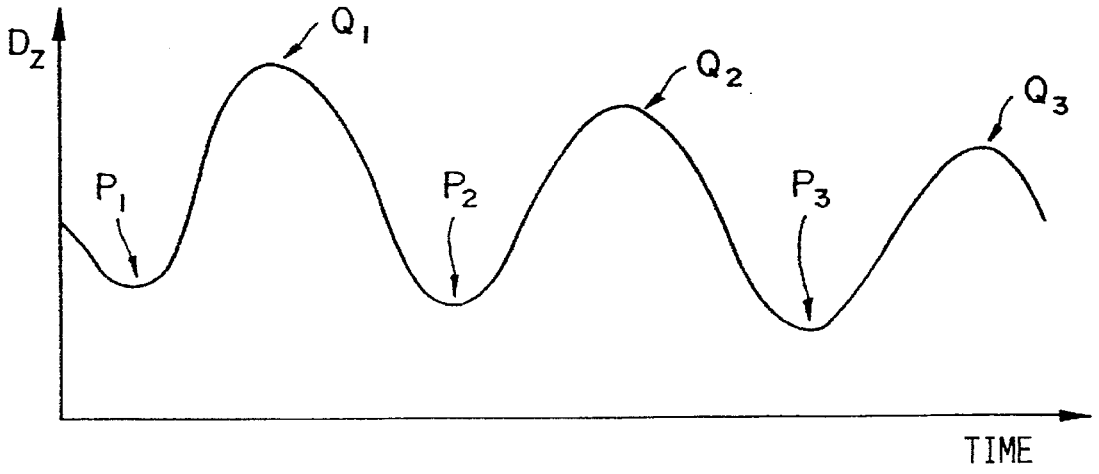
FIG. 4 is a graph showing an example of a variation waveform which represents time-related variation of an absolute angular velocity of a baton.

FIG. 4 shows an example of a variation waveform representing time-related variation of the absolute angular velocity $D_Z$. Herein, three peaks and three bottoms appear in the variation waveform of FIG. 4. The three bottoms correspond to the points $P_1$, $P_2$ and $P_3$ of FIG. 3A respectively in FIG. 3A 'motion 1' is established between the points $P_1$ and $P_2$; 'motion 2' is established between the points $P_2$ and $P_3$; and 'motion 3' is established between the points $P_3$ and $P_1$. The motions 1, 2 and 3 respectively correspond to peaks $Q_1$, $Q_2$ and $Q_3$ of the variation waveform, which further correspond to first, second and third beats in triple time.

Embodiments of the invention are designed to use a fuzzy inference process or a neural network to detect the peaks $Q_1$ to $Q_3$ of the variation waveform as well as to discriminate the motions 1 to 3 (i.e., kinds of peaks). If a result of discrimination indicates the motion 1, the device 10 produces tempo control information TC having a keycode of $C_3$. Similarly, the device 10 produces tempo control information TC having a keycode of $C\#_3$ if the result of discrimination indicates the motion 2, whilst the device 10 produces tempo control information TC having a keycode of $D_3$ if a result of the discrimination indicates the motion 3. The present embodiments are designed to use key data having a certain keycode as the tempo control information. However, the present embodiments can be modified to use certain data, which are specifically used for controlling of a tempo, instead of the key data described above.

In case of duple time or quadruple time shown in FIG. 3B, a swing motion of the baton 32 consists of two motions which are denoted by 'motion 1' and 'motion 3' respectively. Herein, the motion 1 is a swing-down motion which is established between points $P_{11}$ and $P_{12}$. The motion 3 is a swing-up motion which is established between the points $P_{12}$ and $P_{11}$. Now, processes similar to those used for the case of triple time are employed to produce tempo control information TC. Specifically, the device 10 produces tempo control information TC having a keycode of $C_3$ with respect to the motion 1, whilst the device 10 produces tempo control information TC having a keycode of $D_3$ with respect to the motion 3.

Figure 5:
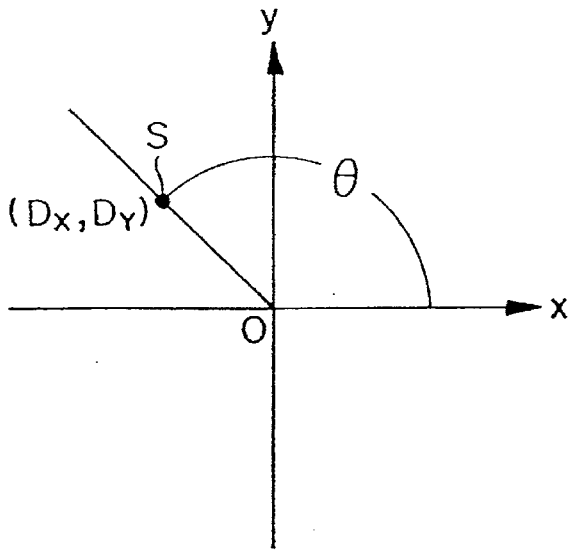
FIG. 5 is an example of a quadrant showing an angle θ which is used for discrimination of motions.

FIG. 5 is an example of a quadrant showing an angle θ which is formed in a x-y plane. In the x-y plane shown in FIG. 5, a point S is plotted in response to the digital outputs $D_X$ and $D_Y$ of the A/D converter circuits 16 and 18. A straight line is drawn to pass an origin 'O' and the point S. So, the angle θ is defined as an angle which is formed between the straight line and a x-axis. Information regarding the angle θ is used to discriminate the motions 1 to 3 (i.e., kinds of peaks) by employing the fuzzy inference process or neural network.

[B] Fuzzy inference process

Next, software architecture, which is constructed in accordance with a first embodiment of the invention, will be described.

FIG. 6 shows a sensor output process which is executed every time the timer 26 issues an interrupt instruction signal; in other words, FIG. 6 shows a sensor output process which is executed in a period of 10 ms.

In step 80, the CPU 20 reads digital outputs $D_X$ and $D_Y$ of the A/D converter circuits 16 and 18. In step 82, the CPU 20 calculates an absolute angular velocity $D_Z$ in accordance with the aforementioned equation (1).

In step 84 a peak detection process is executed in the peak detection process, the CPU 20 detects each of the peaks $Q_1$ to $Q_3$ of the variation waveform of FIG. 4. In addition, the CPU 20 discriminates which beat in triple time corresponds to the peak currently detected. Details of the peak detection process will be described later with reference to FIG. 7.

In step 86, the CPU 20 creates dynamics control information DC, which is sent out by means of the MIDI interface 28. The dynamics control information DC is used to designate a tone-volume level which corresponds to a value of the peak which is detected by the peak detection process of step 84. The dynamics control information DC is transmitted to the electronic musical apparatus 50 of FIG. 2 via the MIDI interface 28 of the swing-motion analyzing device 10 of FIG. 1. The dynamics control information DC is set to a tone-volume control register which is provided in the RAM 66. Thereafter, program control returns to a main routine (not shown).

Figure 7:
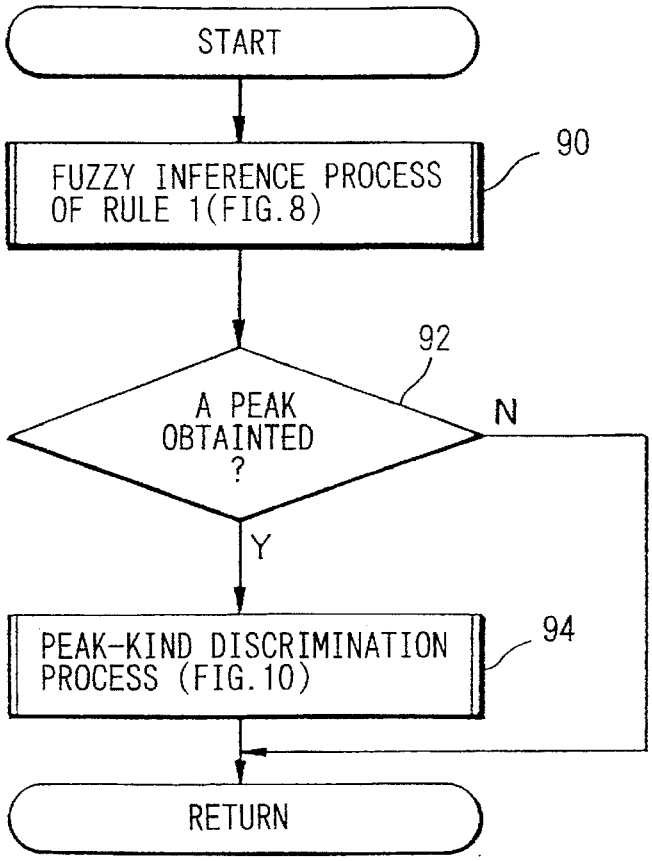
FIG. 7 is a flowchart showing a peak detection process using the fuzzy inference process.

FIG. 7 shows the details of the peak detection process. In step 90, the CPU (e.g., CPU 20) executes a fuzzy inference process of Rule 1. In this fuzzy inference process, the CPU calculates a probability that a 'preceding' value of $D_Z$, which has been calculated prior to a 'current' value of $D_Z$, coincides with a peak. If the probability meets some conditions, it is declared that the peak is detected. Details of peak detection will be described later with reference to FIG. 8 and FIGS. 9A to 9G.

In step 92, a decision is made as to whether the peak is detected by the fuzzy inference process of step 90. If a result of the decision is 'YES', the CPU proceeds to step 94.

In step 94, the CPU executes a peak-kind discrimination process. The peak-kind discrimination process is used to discriminate which beat in triple time corresponds to the peak currently detected. In other words, the CPU discriminates one of the motions 1 to 3 of FIG. 3A, for example.

Details of the peak-kind discrimination process will be described later with reference to FIG. 10.

If the step 94 is completed or if the result of the decision made by the step 92 is 'NO', program control returns to the sensor output process of FIG. 6.

Figure 8:
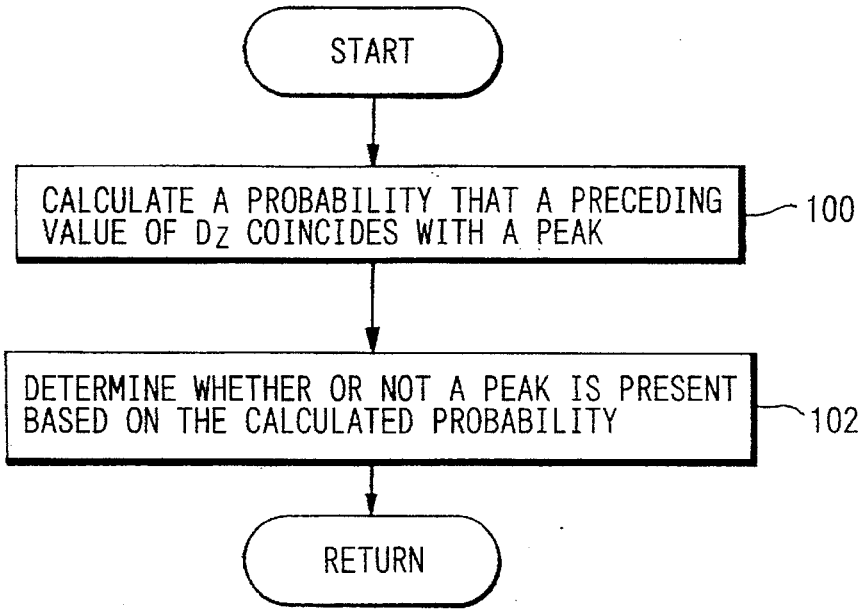
FIG. 8 is a flowchart showing a fuzzy inference process of Rule 1.

FIG. 8 shows details of the fuzzy inference process of Rule 1. In step 100, the CPU calculates a probability that the preceding value of $D_Z$ coincides with a peak. An example of 'Fuzzy Rule 1' can be expressed by conditions [a] to [g], as follows:

[a] A preceding value is greater than a previous value which is calculated prior to the preceding value.

[b] The preceding value is greater than a current value which is currently calculated.

[c] A certain time elapses after a previous peak timing at which a previous peak appears.

[d] The preceding value is greater than a 'dynamic' threshold value.

[e] A certain time elapses after a previous bottom timing at which a previous bottom appears.

[f] The preceding value is not so smaller than a value of the previous peak.

[g] There is a great probability that the preceding value coincides with a peak.

If all the 'basic' conditions [a] to [f] are satisfied, the 'resultant' condition [g] is then established as a result of the fuzzy inference process.

Now, the aforementioned 'dynamic' threshold value is a value which is obtained by averaging values of $D_Z$ which are sequentially calculated in a certain period of time.

Next, languages which are used as variables for the Fuzzy Rule 1 are represented by membership functions. FIGS. 9A to 9G show examples of membership functions which respectively correspond to the conditions [a] to [g] of the Fuzzy Rule 1, wherein 't' designates time.

Now, a membership value is calculated with respect to an input for each of the membership functions shown in FIGS. 9A to 9G. In a graph of FIG. 9A, '$D_2$' represents a previous value of $D_Z$, so that a membership value corresponding to a preceding value of $D_Z$ is indicated by '$M_1$' shown by a dotted line in a graph of FIG. 9B, '$D_0$' represents a current value of $D_Z$, so that a membership value corresponding to a preceding value of $D_Z$ is indicated by '$M_2$' shown by a dotted line. In a graph of FIG. 9C, a membership value corresponding to an elapsed time which elapses after a previous peak timing at which a previous peak appears is indicated by '$M_3$' shown by a dotted line. In a graph of FIG. 9D, '$D_d$' represents a dynamic threshold value, so that a membership value corresponding to a preceding value of $D_Z$ is indicated by '$M_4$' shown by a dotted line, where $M_4$=1. In a graph of FIG. 9E, a membership value corresponding to an elapsed time after a previous bottom timing at which a previous bottom appears is indicated by '$M_5$' shown by a dotted line. In a graph of FIG. 9F, '$D_p$' represents a value of a previous peak, so that a membership value corresponding to a preceding value of $D_Z$ is indicated by '$M_6$' shown by a dotted line.

Figure 9A:
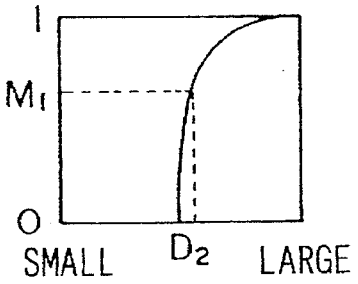
FIGS. 9A to 9G are graphs showing membership functions used by the fuzzy inference process.
Figure 9B:
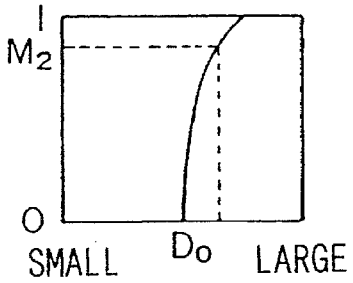
Figure 9C:
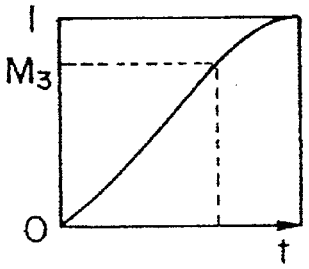
Figure 9D:
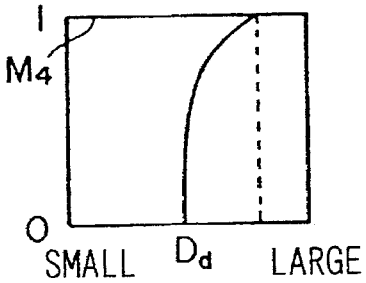
Figure 9E:
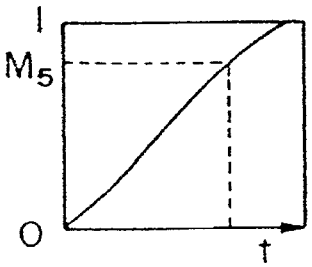
Figure 9F:
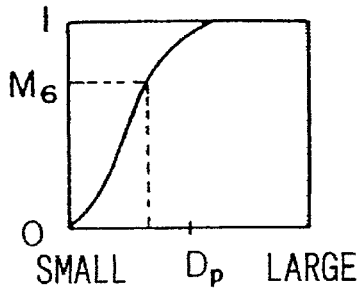
Figure 9G:
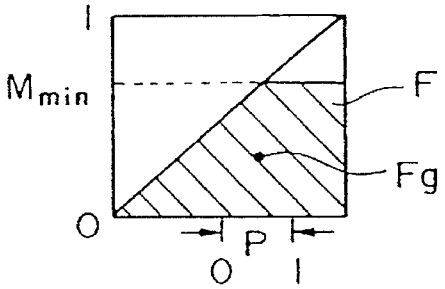

Next, a final result of inference is computed based on a result of inference which is computed by the membership functions of FIGS. 9A to 9F. As described before, all the conditions [a] to [f] are interconnected together by 'AND' logic. So, a minimum value '$M_{min}$' is selected from among the membership values $M_1$ to $M_6$. Then, the minimum value $M_{min}$ is applied to a vertical axis of a graph of FIG. 9G. In FIG. 9G, a triangle figure 'F' is formed between a horizontal axis and a slanted line which is originated from an origin '0'. A top portion whose level exceeds the minimum value $M_{min}$ is excluded from the triangle figure F to form a trapezoidal figure (see a hatched part of FIG. 9G). Then, a center of gravity 'Fg' is calculated with respect to the trapezoidal figure. Herein, a range of variation 'P' of the center of gravity Fg coincides with a range of probability between '1' and '0'. So, a probability of presence of a peak is calculated in response to the center of gravity Fg under consideration of the range of variation P.

Next, the CPU proceeds to step 102 of the fuzzy inference process of FIG. 8. Herein, a decision is made as to whether or not a peak is established based on the probability which is calculated by the step 100. That is, a decision is made as to whether or not the calculated probability is equal to or greater than a certain value (e.g., 0.5) if a result of the decision is 'YES', it is declared that the peak is detected. If not, it is declared that the peak is not detected. Thereafter, program control returns to the peak detection process of FIG. 7.

Figure 10:
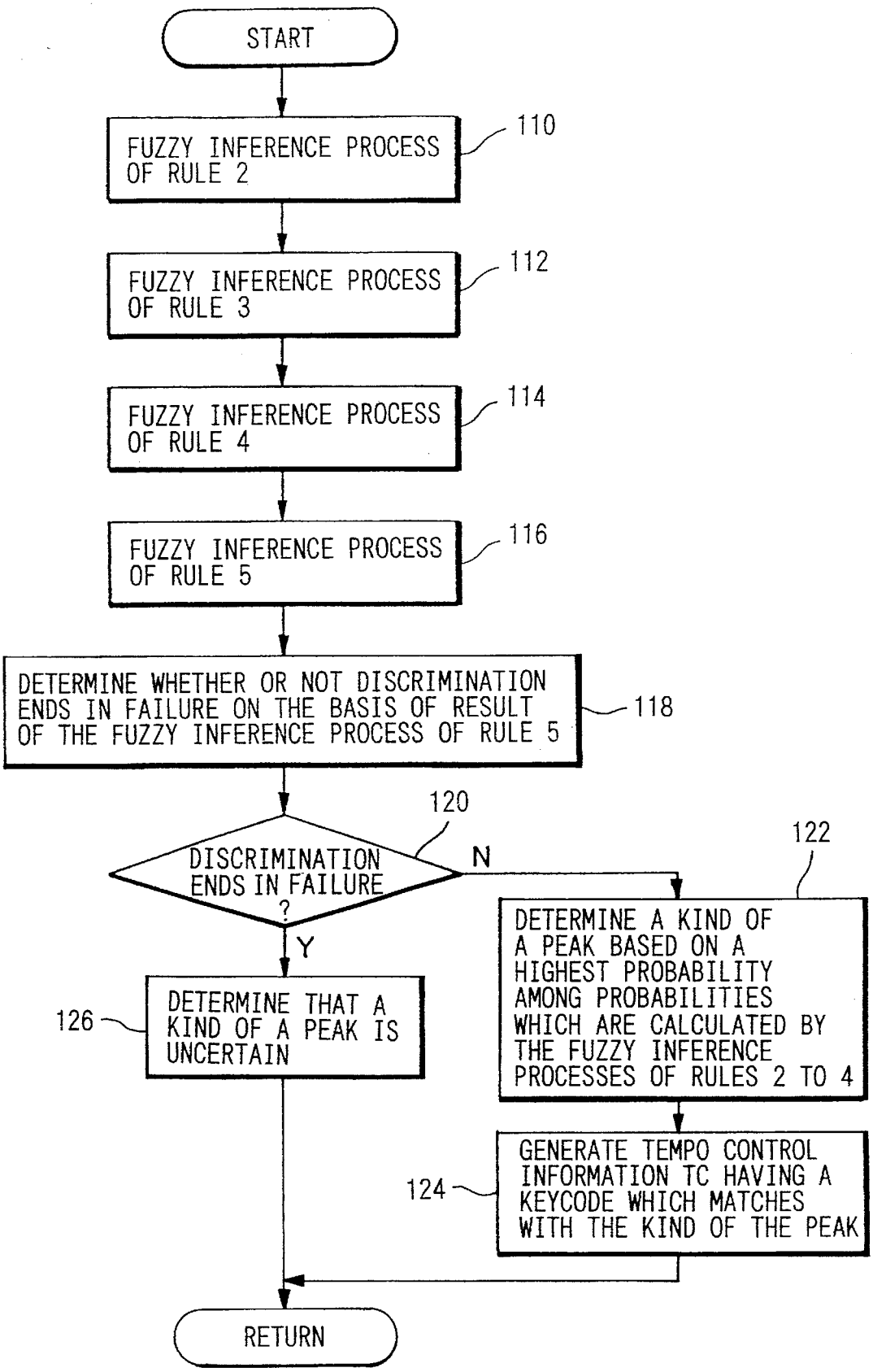
FIG. 10 is a flowchart showing a peak-kind discrimination process.

FIG. 10 shows a peak-kind discrimination process. In step 110, the CPU executes a fuzzy inference process of Rule 2. In this fuzzy inference process, the CPU calculates a probability that a kind of a peak currently detected coincides with the motion 1. An example of the content of Fuzzy Rule 2 can be described by conditions as follows:

Condition 1: a digital output $D_Y$ is small but a digital output $D_X$ is large.

Condition 2: a kind of a previous peak coincides with the motion 3.

Condition 3: a kind of a previous peak coincides with the motion 2 and an angle difference between a previous peak and a current peak is large.

Condition 4: a current angle is medium.

Condition 5: there is a great probability that a kind of a current peak coincides with the motion 1.

Now, if one of the 'basic' Conditions 1 to 3 is established together with the 'basic' Condition 4, the 'resultant' Condition 5 is then established as a result of the fuzzy inference process. By the way, definition of the 'angle' is described before in conjunction with FIG. 5, so the 'angle difference' is defined as a difference between the angles.

The fuzzy inference process of Rule 2 can be executed similar to the aforementioned fuzzy inference process of Rule 1. That is, languages which correspond to variables in the Fuzzy Rule 2 are represented by membership functions. Then, a membership value is calculated with respect to an input to each of the basic Conditions 1 to 4. Specifically, a 'minimum' membership value is calculated with respect to the basic Condition 4, whilst a 'maximum' membership value is calculated with respect to each of the basic Conditions 1 to 3. A probability that the kind of the current peak coincides with the motion 1 is calculated in accordance with a center-of-gravity method based on a membership function which corresponds to the resultant Condition 5.

In step 112 of the peak-kind discrimination process of FIG. 10, the CPU executes a fuzzy inference process of Rule 3. In this fuzzy inference process, the CPU calculates a probability that a kind of a current peak coincides with the motion 2. An example of the content of Fuzzy Rule 3 can be described by conditions as follows:

Condition 1: a kind of a previous peak coincides with the motion 1, and an angle difference between a current peak and a previous peak is small.

Condition 2: a kind of a previous peak coincides with the motion 3, and an angle difference between a current peak and a previous peak is large.

Condition 3: an operation to discriminate a kind of a previous peak ends in failure, and a digital output $D_Y$ is large but a digital output $D_X$ is small.

Condition 4: an operation to discriminate a kind of a previous peak ends in failure, and an angle of a current peak is close to 0°.

Condition 5: there is a great probability that a kind of a current peak coincides with the motion 2.

Now, if one of the basic Conditions 1 to 4 is satisfied, the resultant Condition 5 is then established as a result of the fuzzy inference process.

The fuzzy inference process of Rule 3 can be executed similar to the aforementioned fuzzy inference process of Rule 2.

In step 114 of the peak-kind discrimination process of FIG. 10, the CPU executes a fuzzy inference process of Rule 4. In this fuzzy inference process, the CPU calculates a probability that a kind of a current peak coincides with the motion 3. An example of the content of Fuzzy Rule 4 can be described by conditions as follows:

Condition 1: a kind of a previous peak coincides with the motion 2, and an angle difference between a current peak and a previous peak is small.

Condition 2: a kind of a previous peak coincides with the motion 1, and an angle difference between a current peak and a previous peak is large.

Condition 3: an operation to discriminate a kind of a previous peak ends in failure, and a digital output $D_Y$ is large.

Condition 4: there is a great probability that a kind of a current peak coincides with the motion 3.

Now, if one of the basic Conditions 1 to 3 is satisfied, the resultant Condition 4 is then established as a result of the fuzzy inference process.

The fuzzy inference process of Rule 4 can be executed similar to the aforementioned fuzzy inference process of Rule 2.

Next, in step 116 of the peak-kind discrimination process of FIG. 10, the CPU executes a fuzzy inference process of Rule 5. In this fuzzy inference process, the CPU calculates a probability that an operation to discriminate a kind of a current peak ends in failure. An example of the content of Fuzzy Rule 5 can be described by conditions as follows:

Condition 1: all of the probabilities which are calculated by the fuzzy inference processes of Rules 2, 3 and 4 are small.

Condition 2: there is a great probability that an operation to discriminate a kind of a current peak ends in failure.

If the basic Condition 1 is satisfied, the resultant Condition 2 is then established as a result of the fuzzy inference process.

The fuzzy inference process of Rule 5 can be executed similar to the aforementioned fuzzy inference process of Rule 2.

In step 118, a decision is made, based on the result of the fuzzy inference process of Rule 5, as to whether or not discrimination ends in failure. That is, a decision is made as to whether or not the probability calculated in the step 116 is equal to or greater than a certain value (e.g., 0.5) if a result of the decision is 'YES', it is judged that discrimination ends in failure. If not, it is judged that the discrimination does not fall. Thereafter, the CPU proceeds to step 120.

In step 120, a decision is made as to whether or not failure occurs in discrimination. If a result of the decision is 'NO', the CPU proceeds to step 122 in which a kind of a peak is determined based on a highest probability among the probabilities which are calculated by the fuzzy inference processes of Rules 2 to 4. If the probability which is calculated by the fuzzy inference process of Rule 2 is the highest, it is determined that a kind of a peak coincides with the motion 1.

In step 124, the device 10 generates tempo control information TC having a keycode which corresponds to the kind of the peak determined by the step 122. For example, if the kind of the peak coincides with the motion 1, the device 10 generates tempo control information TC having a keycode of $C_3$. Then, the tempo control information TC is transmitted to the RAM 66 by means of the interfaces 28 and 70, wherein the tempo control information TC is set to a certain register which is provided in the RAM 66.

On the other hand, if a result of the decision of the step 120 is 'YES', the CPU proceeds to step 126 in which that the CPU declares that a kind of a peak is uncertain. After completion of the step 124 or 126, program control returns to the peak detection process of FIG. 7.

Figure 11:
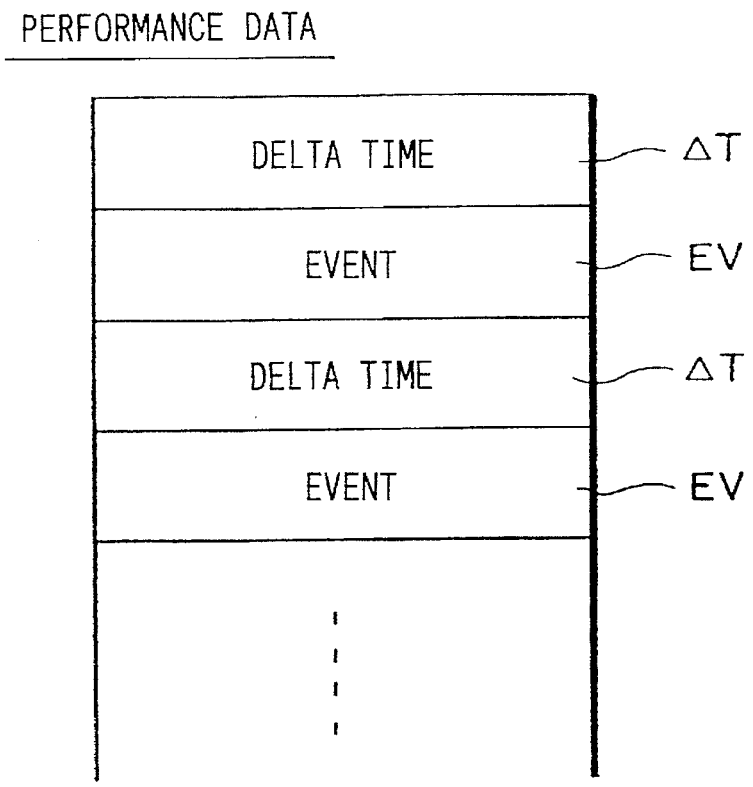
FIG. 11 shows a data format of performance data stored in a RAM of an electronic musical apparatus of FIG. 2.

FIG. 11 shows a data format of performance data stored in the RAM 66.

The performance data are constructed by delta-time data ΔT, event data EV, delta-time data ΔT, event data EV, . . . That is, the performance data consist of the delta-time data ΔT and event data EV which are alternatively arranged in accordance with progression of a tune. Each delta-time data ΔT represent a time in a unit of milli-seconds [ms]. Herein first delta-time data represent a time which elapses until a first event, whilst delta-time data provided between two event data represent a relative time between two events. As for generation of a chord representing multiple events which should occur at one timing, delta-time data between the events represent 'zero', for example.

Figure 12:
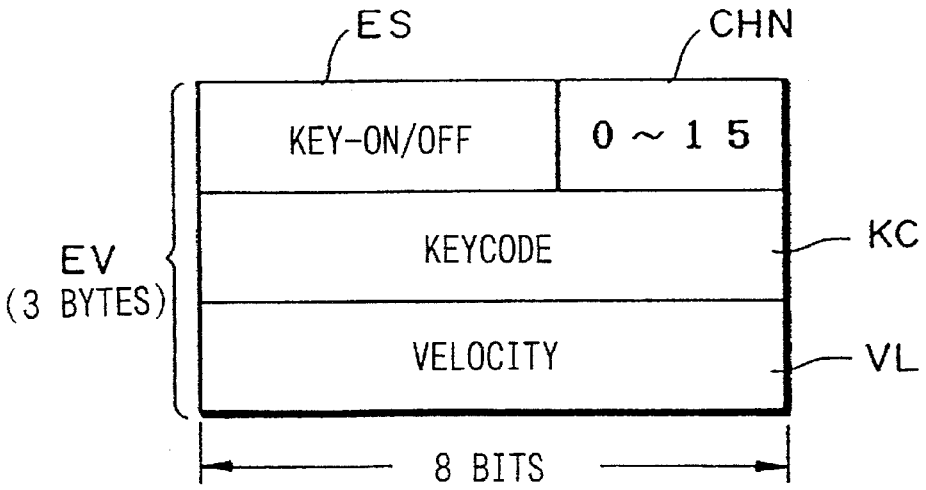
FIG. 12 shows a data format of event data which are contained in the performance data.

Each event data EV consist of 3 bytes, each containing 8 bits, as shown in FIG. 12. As for a first byte, high-order 4 bits correspond to event-kind data ES, whilst low-order 4 bits correspond to channel-number data CHN. The event-kind data ES represent a kind of an event such as a key-on event or a key-off event. The channel-number data CHN represent a channel number which is selected from among numbers of '0' to '15'. The channel numbers '1' to '15' respectively correspond to the aforementioned channels 1 to channel 15 of the sound source circuit 60. Incidentally, the channel number 0 is used as a tempo control mark.

A second byte of the event data EV correspond to keycode data KC which represent a tone pitch. A third byte corresponds to velocity data VL which represent a tone volume corresponding to a key-depression speed.

As the event data EV, there exist two kinds of event data, i.e., event data of the channel number 0 provided for a tempo control and event data of the channel numbers 1 to 15 provided for sounding/non-sounding control. The latter event data relate to key-on/off events. The event data for the tone-generation control are provided to control generation of a musical tone signal and to start of attenuation of the musical tone signal with respect to each of notes constructing a tune. Such event data are widely used in fields of automatic performance. On the other hand, the event data for the tempo control are specifically provided to embody the present invention. For convenience' sake, such event data will be referred to as 'tempo control data'.

In case of triple time, the apparatus uses tempo control data having three kinds of keycodes, i.e., $C_3$, $C\#_3$ and $D_3$. The tempo control data having the keycodes of $C_3$, $C\#_3$ and $D_3$ are arranged at first, second and third beats based on a reference tempo respectively. Those data are sequentially read out in such an order of arrangement. In case of quadruple time, there are provided 4 tempo control data respectively having keycodes of $C_3$, $D_3$, $C_3$ and $D_3$, which are arranged at first, second, third and fourth beats respectively. So, those data are sequentially read out in such an order of arrangement. A tempo control is made in response to a relationship between a receiving timing of tempo control information TC and a read timing of tempo control data. For example, a tempo is made faster if a receiving timing of tempo control information TC, having a keycode of $C_3$, progresses ahead of a read timing of tempo control data having a keycode of $C_3$. On the other hand, the tempo is made slower if the receiving timing of the tempo control information TC is delayed behind the read timing of the tempo control data.

[C] Neural Network

Figure 13:
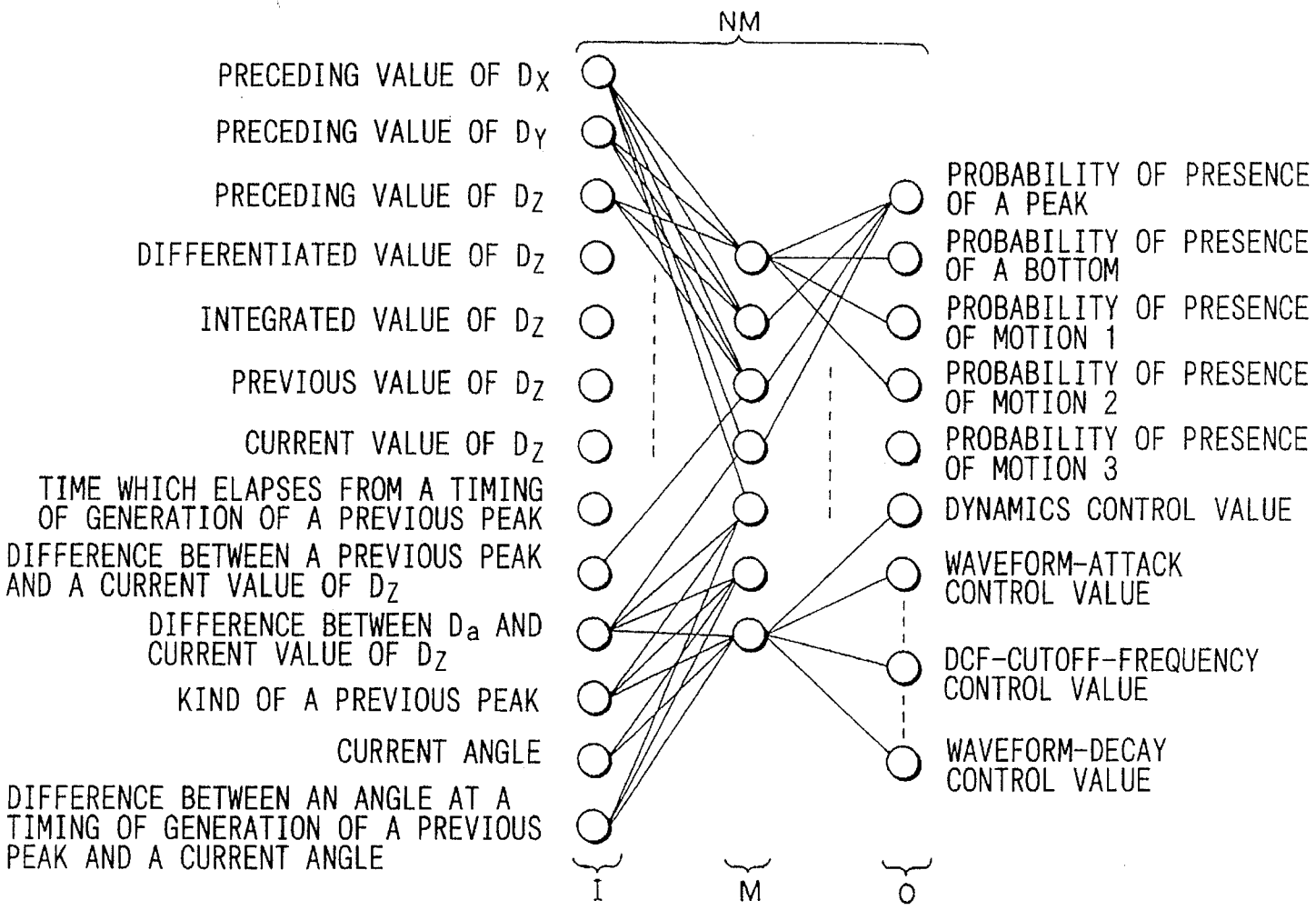
FIG. 13 shows an example of a structure of a neural network which is designed in accordance with a second embodiment of the invention.

FIG. 13 shows an example of inputs and outputs of a neural network 'NM', which is designed for a second embodiment of the invention, together with its parameters. The neural network NM is of a hierarchical type which consists of three layers such as an input layer I, a medium layer (or a hidden layer) M and an output layer O, wherein each circle represents a neuron model. Incidentally, FIG. 13 omits a part of line connections of the neural network NM to avoid complexity of illustration.

In order to obtain information regarding a probability of presence of a peak from the output layer O, it is necessary to provide a preceding value of $D_X$, a preceding value of $D_Y$, a preceding value of $D_Z$, a difference between a previous peak and a current value of $D_Z$, a difference between a dynamic threshold value $D_a$ and a current value of $D_Z$, which are inputted to the input layer I. Herein, the dynamic threshold value $D_a$ is a value which is obtained by averaging values of $D_Z$ which are calculated in a predetermined period of time.

In order to obtain information regarding a probability of presence of a bottom from the output layer O, it is necessary to provide a preceding value of $D_X$, a preceding value of $D_Y$ and a preceding value of $D_Z$, which are inputted to the input layer I.

In order to obtain information regarding a probability of presence of the motion 1 from the output layer O, it is necessary to provide a preceding value of $D_X$, a preceding value of $D_Y$ and a preceding value of $D_Z$, which are inputted to the input layer I. Similarly, by inputting necessary values (or parameters) to the input layer I, it is possible to obtain information regarding a probability of presence of the motion 2 as well as information regarding a probability of presence of the motion 3 from the output layer O.

As the aforementioned musical-tone control information SC, there are provided control values for the dynamics (i.e., intensity of sound), control values for attack portions of waveforms, control values for cut-off frequencies of DCFs (i.e., digital controlled filters), control values for decay portions of waveforms, and the like.

In order to obtain a dynamics control value, it is necessary to provide a difference between a dynamic threshold value $D_a$ and a current value of $D_Z$, a kind of a previous, in current angle (i.e., θ in FIG. 5) and a difference between angles at a timing of generation of a previous peak and a current timing, which are inputted to the input layer I. Similarly, by inputting necessary values (or parameters) to the input layer I, it is possible to obtain a waveform-attack control value, a DCF-cutoff-frequency control value and a waveform-decay control value from the output layer O.

Construction of the neural network NM shown in FIG. 13 is merely an example. So, it is possible to use other parameters for the neural network. For example, it is possible to input information regarding a current tempo value and beats of a tune. Or, the neural network can be modified to produce control values for controlling an EG (i.e., envelope generator, not shown) provided in the sound source circuit 60. In addition, all the parameters shown in FIG. 13 are not necessarily used; hence, some of the parameters can be omitted on demand.

Further, the neural network NM can be constructed in such a way that the content thereof is modified responsive to the learning made by a user to enable a desired control operation.

FIG. 14 shows a sensor output process which is designed in accordance with the second embodiment of the invention. This sensor output process is executed every time the timer 26 issues an interrupt instruction signal. That is, execution of the sensor output process is made by a period of 10 ms.

In step 280, the CPU (e.g., CPU 20) reads digital outputs $D_X$ and $D_Y$ from the A/D converter circuits 16 and 18. In step 282, the CPU calculates an absolute angular velocity $D_Z$ in accordance with the aforementioned equation (1).

In step 282, the CPU calculates other necessary values (e.g., differentiated values, integrated values and angles shown in FIG. 13). Then, the CPU proceeds to step 286.

In step 286, the CPU executes a peak detection process. In the peak detection process, the CPU detects peaks such as $Q_1$ to $Q_3$ shown in FIG. 4; and the CPU also discriminates which beat corresponds to the peak detected. Details of the peak detection process will be described below with reference to FIG. 15. After completion of the step 286, program control returns to a main routine (not shown).

Figure 15:
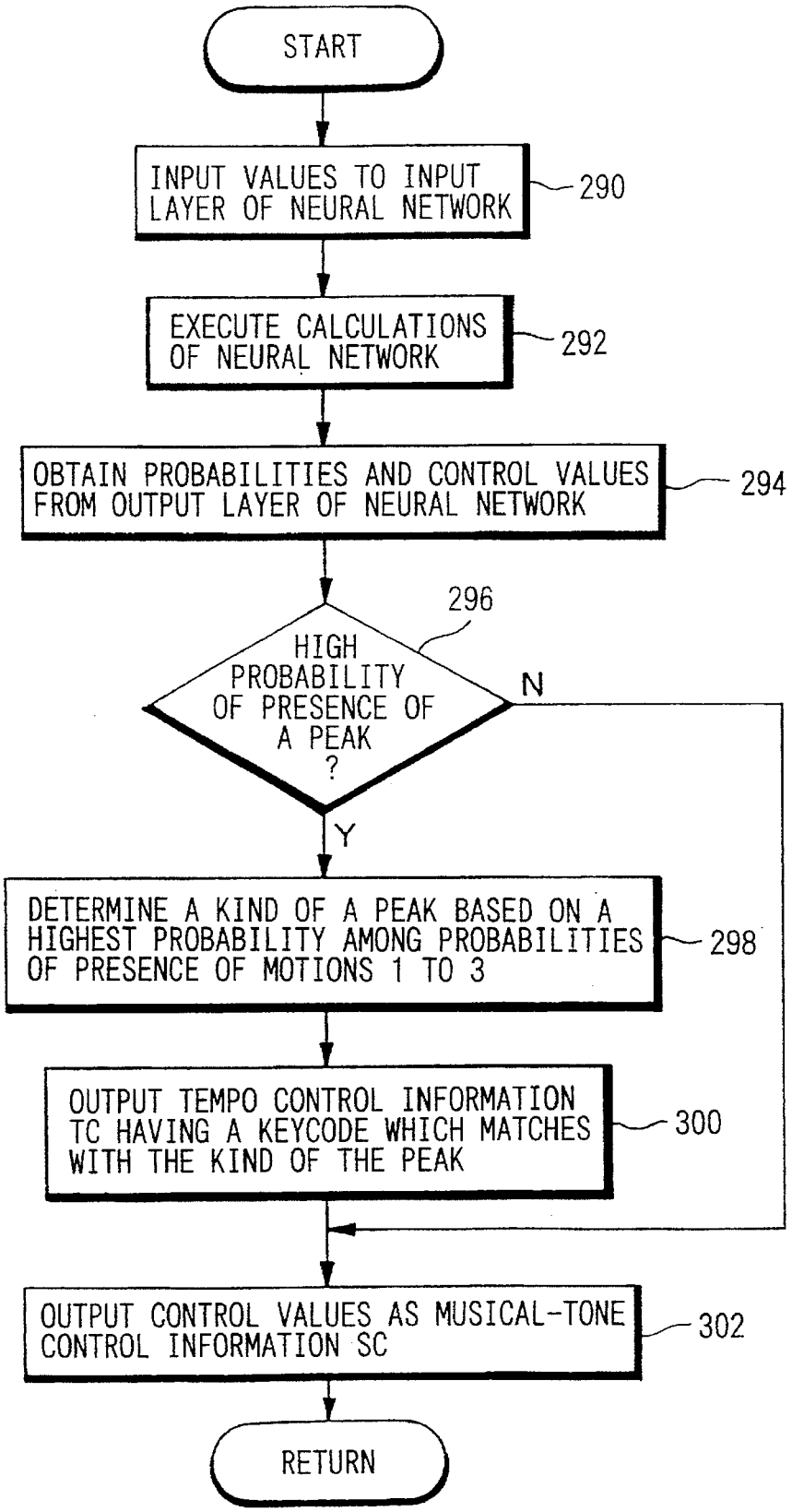
FIG. 15 is a flowchart showing a peak detection process using the neural network.

FIG. 15 shows the peak detection process, wherein the CPU firstly proceeds to step 290 in which a variety of values are inputted to the input layer I of the neural network NM shown in FIG. 13. In step 292, the CPU executes calculations for the neural network NM. The content of the neural network NM is stored in the ROM 22 in the form of the software. So, the CPU 20 executes the calculations in accordance with programs of the neural network NM.

In step 294, the CPU obtains a variety of probabilities and control values, which are shown in FIG. 13, from the output layer O of the neural network NM. Then, the CPU proceeds to step 296.

In step 296, the CPU uses the probability of presence of a peak, which is obtained by executing the calculations, to make a decision as to whether the probability is high. If the probability is equal to or greater than a certain value (e.g., 0.5), the CPU determines that the probability is high. If a result of the decision is 'YES', the CPU proceeds to step 298.

In step 298, the CPU selects a highest probability from among the probability of presence of the motion 1, probability of presence of the motion 2 and probability of presence of the motion 3, so that the CPU determines that a kind of a peak coincides with one of the motions corresponding to the highest probability. For example, if the probability of presence of the motion 1 is the highest, the CPU determines that a kind of a peak coincides with the motion 1. Then, the CPU proceeds to step 300.

In step 300, the device 10 outputs tempo control information TC having a keycode corresponding to the kind of the peak which is determined by the step 298. For example, if the CPU determines in step 298 that the kind of the peak coincides with the motion 1, the device 10 outputs tempo control information TC having a keycode of $C_3$ which corresponds to the motion 1. Then, the tempo control information TC, outputted from the device 10, is transmitted to the apparatus 50 by means of the interfaces 28 and 70, wherein the tempo control information TC is set to a certain register which is provided in the RAM 66.

After completion of the step 300, or if a result of the decision made by the step 296 is 'NO' indicating that the probability of presence of a peak is not high the CPU proceeds to step 302 so as to output a variety of control values as the musical-tone control information SC. Among the control values, a dynamics control value is transferred to the apparatus 50 by means of the interfaces 28 and 70, wherein it is set to a tone-volume control register which is provided in the RAM 66. Other control values, such as a waveform-attack control value, a DCF-cutoff-frequency control value and a waveform-decay control value, are set to corresponding registers which are provided in the sound source circuit 60.

The dynamics control value, which is set to the tone-volume control register of the RAM 66, is used to control a tone volume of a performance sound. Among the other control values which are set to the registers of the sound source circuit 60, the waveform-attack control value is used to control a speed and a level at a rising portion of a sound; the DCF-cutoff-frequency control value is used to control a cutoff frequency of a DCF; the waveform-decay control value is used to control an attenuation speed of a sound. Thanks to the above controlling, it is possible to perform a delicate tone-color control.

Figure 16:
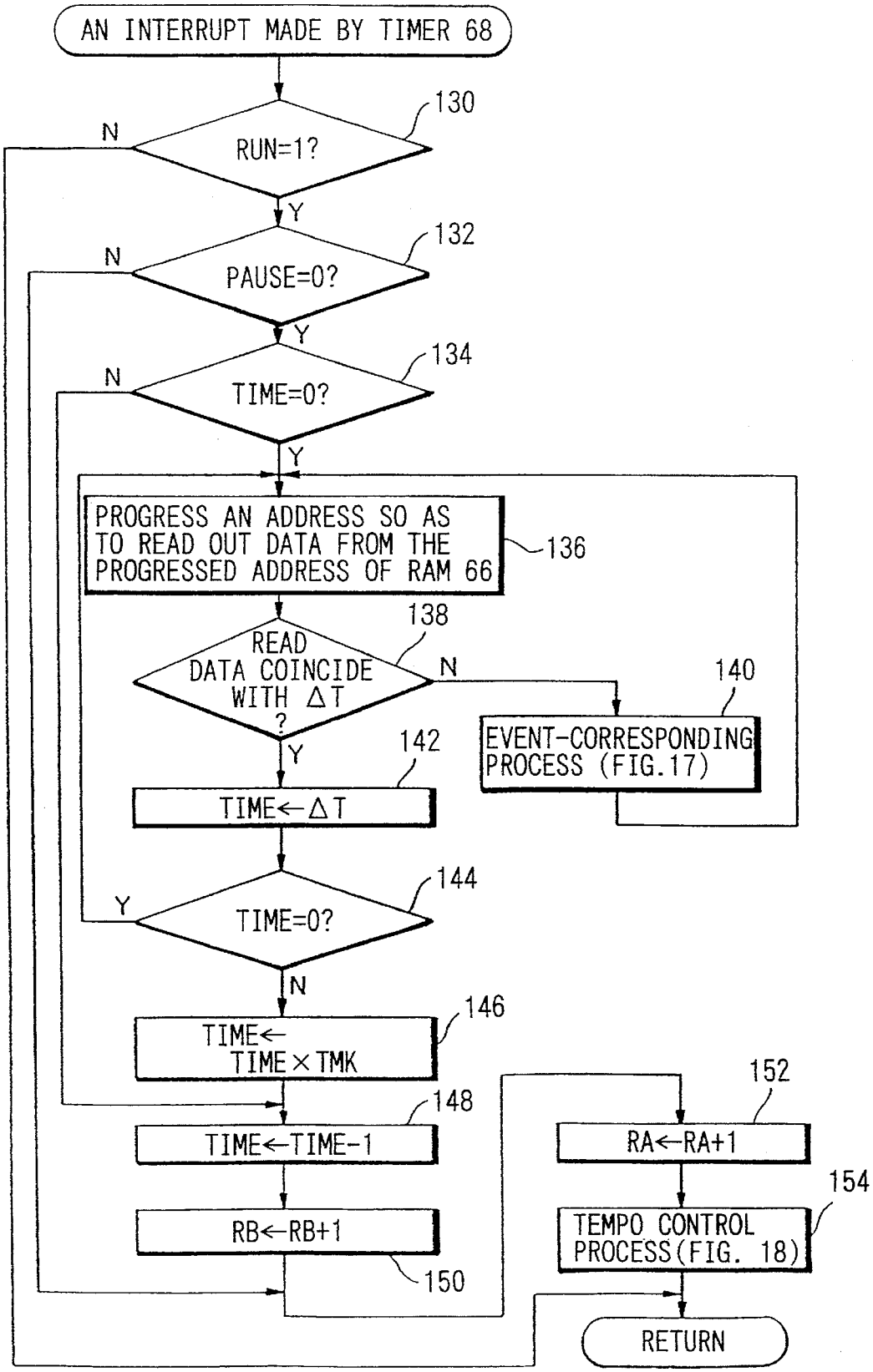
FIG. 16 is a flowchart showing a playback process.

FIG. 16 shows a playback process. This playback process is executed every time the timer 68 issues an interrupt instruction signal. That is, execution of the playback process is initiated by a period of 1 ms. Incidentally, the content of the playback process will be explained using a variety of flags and registers which are provided in the RAM 66.

In first step 130 of the playback process of FIG. 16, a decision is made as to whether or not '1' is set to a run flag 'RUN'. The value of the run flag RUN is changed every time the aforementioned performance-start switch is turned ON. So, if the switch is turned ON under a state where '1' has been already set to the flag RUN, the value of the flag RUN is changed to '0'. Or, if the switch is turned ON under a state where '0' has been already set to the flag RUN, the value of the flag RUN is changed to '1'. An event of RUN=1 indicates a state where automatic performance is currently progressing. If a result of the decision is 'YES', the CPU (e.g., CPU 62) proceeds to step 132.

In step 132, a decision is made as to whether or not '0' is set to a read stop flag 'PAUSE'. This flag PAUSE is set at '1' if although tempo control data are read out from the RAM 66, the apparatus does not receive its corresponding tempo control information TC until a read timing of the tempo control data. If a result of the decision is 'YES' (indicating that the apparatus received the tempo control information TC), the CPU proceeds to step 134.

In step 134, a decision is made as to whether or not '0' is set to a delta-time register 'TIME'. Herein, delta-time data ΔT, which are read out from the RAM 66, are set to the register TIME (see step 142). In addition, a value represented by the delta-time data ΔT is decreased by '1' every time an interrupt occurs (see step 148). So, an event of TIME=0 indicates that it comes to a timing at which next event data should be read out. If a result of the decision of the step 134 is 'YES', the CPU proceeds to step 136.

In step 136 an address of the RAM 66 is progressed by '1' so that data are read out from a progressed address. In next step 138, a decision is made as to whether or not read data coincide with delta-time data ΔT. If the CPU proceeds to the step 138 at first after completion of the step 134, a result of the decision of the step 138 turns to 'NO'. Because, a reading operation of delta-time data ΔT should be followed by a reading operation of event data EV. So, the CPU proceeds to step 140. In step 140, the CPU executes an event-corresponding process, details of which will be described later with reference to FIG. 17. After completion of the step 140, the CPU proceeds back to step 136.

In step 136, an address of the RAM 66 is progressed again, so that data are read out from a progressed address. In next step 138, a decision is made as to whether or not read data coincide with delta-time data ΔT. In this case, a result of the decision turns to 'YES', so that the CPU proceeds to step 142.

In step 142, the delta-time data ΔT which are read out by the step 136 are set to the register TIME. In next step 144, a decision is made as to whether or an event of TIME=0 occurs. Normally, the delta-time data ΔT are not set at '0' just after a reading operation thereof. However, an event of ΔT=0 may occur in a case of generation of a chord which is described before. In such a case, a result of the decision of the step 144 turns to 'YES'; and consequently, the CPU proceeds back to step 136.

In step 136, next event data are read out from the RAM 66. Thereafter, the CPU proceeds to step 140 through step 138, wherein the CPU executes an event-corresponding process with respect to the next event data. After completion of the step 140, the CPU proceeds back to step 136 again. So, next delta-time data ΔT are read out from the RAM 66; then, the CPU proceeds to step 144 again through steps 138 and 142. In this case, if a result of the decision of the step 144 is 'YES', the CPU proceeds back to step 136 again. In step 136, next event data are read out from the RAM 66; then, the CPU proceeds to step 140 through step 138, wherein the CPU executes an event-corresponding process with respect to the next event data. Thus, the apparatus is substantially capable of simultaneously generating 3 musical tones corresponding to first, second and third constituent notes of a chord. After completion of the step 140, a series of steps 136, 138, 142 and 144 are repeated as described above.

Now, if a result of the decision of the step 144 is 'NO', the CPU proceeds to step 146. In step 146, a value of the register TIME is multiplied by a value of a tempo coefficient register 'TMK' (i.e., a tempo coefficient TMK), so that a result of multiplication is set to the register TIME.

A reference value of '1' is set to the tempo coefficient TMK. This tempo coefficient TMK is varied from '1' in response to a swinging speed of the baton 32. That is, the tempo coefficient TMK is made smaller than '1' if the swinging speed of the baton 32 is made faster, whilst the tempo coefficient TMK is made greater than '1' if the swinging speed of the baton 32 is made slower. Such a variation of the tempo coefficient TMK is achieved by a tempo control process of step 154. In short, a value of the register TIME is corrected by multiplication of the tempo coefficient TMK. As a result, a tempo of automatic performance is controlled to follow a swinging speed of the baton 32.

After completion of the step 146, or if a result of the decision of the step 134 is 'NO' (indicating that it does not come to a timing to read out next event data), the CPU proceeds to step 148. In step 148, a value of the register TIME is decreased by '1'. Then, the CPU proceeds to step 150 in which a value of a read interval register RB is increased by '1'. The register RB is used to provide a numerical value corresponding to an interval of time between a read timing of tempo control data $TEV_1$ and a read timing of next tempo control data $TEV_2$ shown in FIG. 19, for example.

After completion of the step 150, or if a result of the decision of the step 132 is 'NO' (indicating that the apparatus waits for tempo control information TC to be transmitted thereto), the CPU proceeds to step 152. In step 152, a value of a receiving interval register RA is increased by '1'. The register RA is used to provide a numerical value corresponding to an interval of time between a receiving timing of tempo control information $TC_1$ and a receiving timing of next tempo control information $TC_2$ shown in FIG. 19, for example. After completion of the step 152, the CPU proceeds to step 154 so as to execute the tempo control process, details of which will be described later with reference to FIG. 18.

After completion of the step 154, of if a result of the decision of the step 130 is 'NO' (indicating that automatic performance is not currently progressing), program control return to a main routine (not shown).

Figure 17:
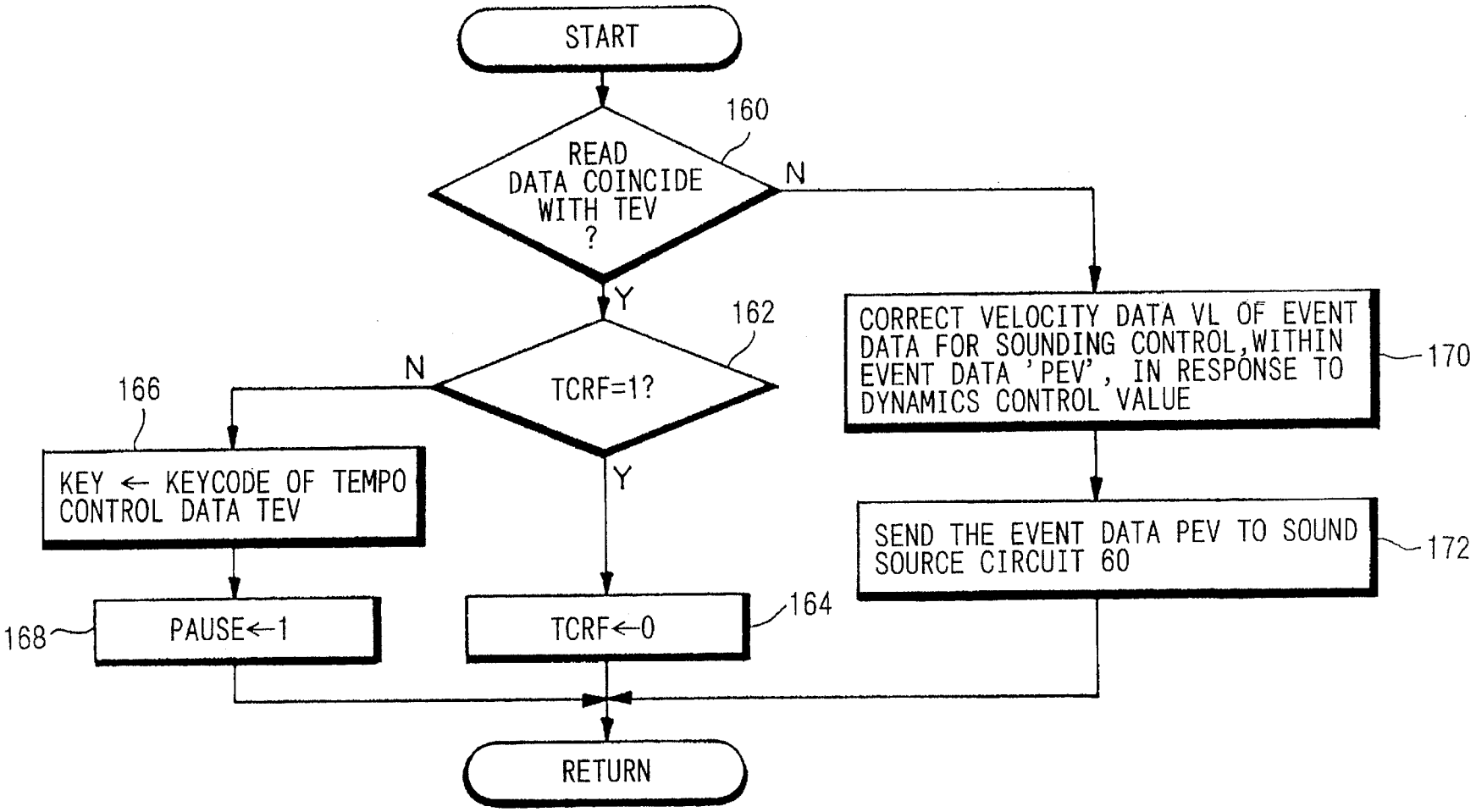
FIG. 17 is a flowchart showing an event-corresponding process.

FIG. 17 shows the event-corresponding process (see step 140 shown in FIG. 16). In first step 160, a decision is made as to whether or not read data, which are read by the aforementioned step 136 shown in FIG. 16, coincide with tempo control data TEV. If a result of the decision is 'YES', the CPU proceeds to step 162.

In step 162, a decision is made as to whether or not '1' is set to a receiving flag 'TCRF'. In other words, a decision is made as to whether or not the apparatus has already received tempo control information TC. If a result of the decision is 'YES', the CPU proceeds to step 164 in which '0' is set to the register TCRF. This value '0' indicates that when the tempo control data TEV are read out, the apparatus has already received its corresponding tempo control information TC.

If a result of the decision of the step 162 is 'NO', the CPU proceeds to step 166 in which keycode data KC contained in the tempo control data TEV are set to a register KEY. In next step 168, '1' is set to the register PAUSE. This step is required to stop reading of performance data from the RAM 66 until the apparatus receives tempo control information TC corresponding to the tempo control data TEV. In the aforementioned playback process of FIG. 16, if the step 132 detects an event of PAUSE=1, the CPU directly proceeds to step 152 without executing a reading process corresponding to the steps 136 to 146. Then, if the apparatus receives the tempo control information TC, a value of the register PAUSE is set at '1' by the tempo control process of step 154. Thereafter, the apparatus carries out a reading operation to read out performance data from the RAM 66.

If a result of the decision of the step 160 is 'NO', the CPU proceeds to step 170. In step 170, event data provided for sounding control only are selected from among event data 'PEV" for sounding/non-sounding control; then, a value of velocity data 'VL' of the event data selected is corrected in response to a dynamics control value which is stored in the tone-volume control register provided in the RAM 66. For example, if a swing of the baton is intense, the value of the velocity data VL are corrected to increase a tone volume in response to the dynamics control value. After completion of the step 170, the CPU proceeds to step 172.

In step 172, the event data PEV for sounding/non-sounding control are transferred to the sound source circuit 60. In this case, if event data for sounding control (i.e., event data regarding a key-on event) are transferred to the sound source circuit 60, the circuit starts generation of a corresponding musical tone signal. If event data for non-sounding control (i.e., event data regarding a key-off event) are transferred to the sound source circuit 60, the circuit starts attenuation of a corresponding musical tone signal.

After completion of the step 164, 168 or 172, program control returns to the aforementioned playback process of FIG. 16.

Figure 18:
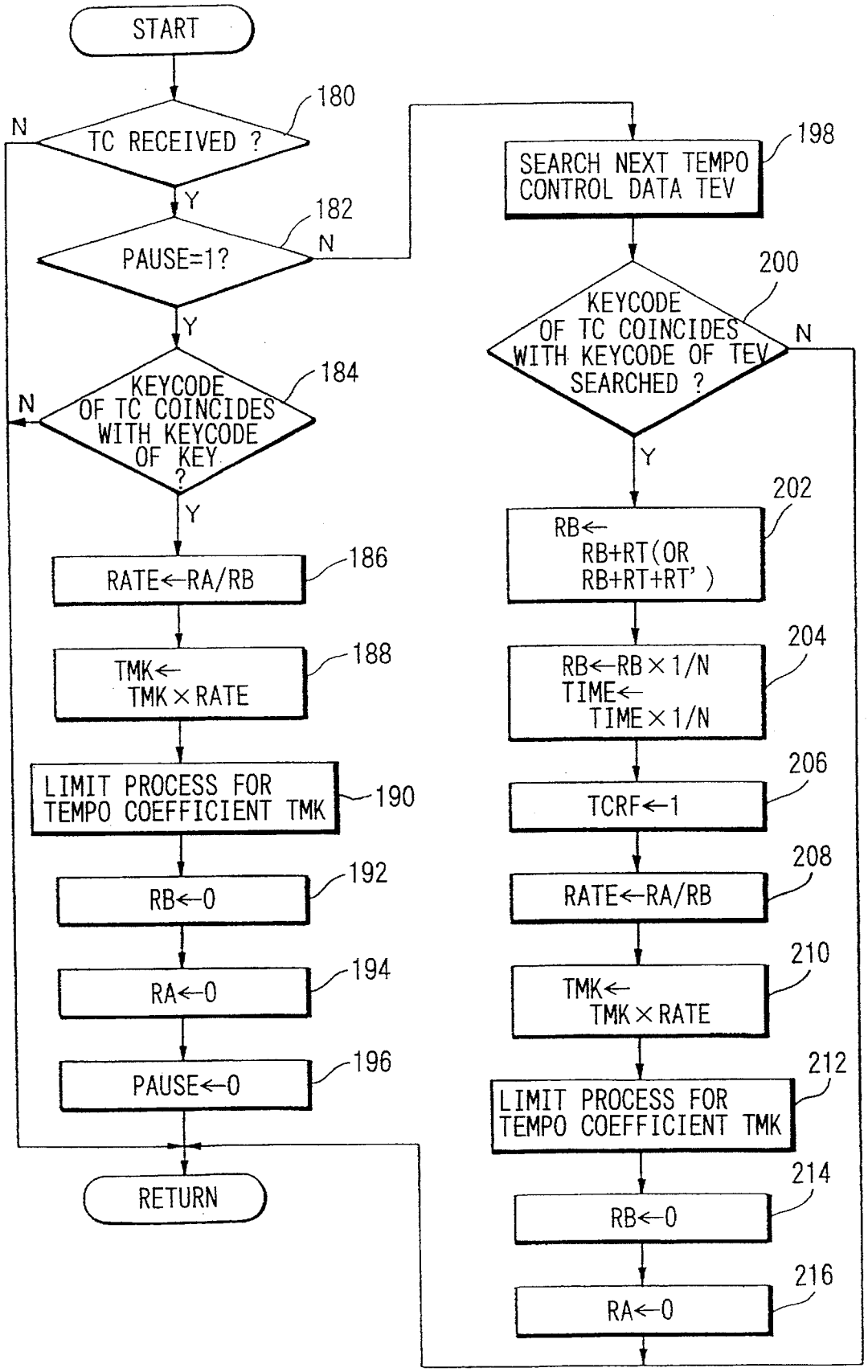
FIG. 18 is a flowchart showing a tempo control process.

FIG. 18 shows the tempo control process (see step 154 shown in FIG. 16). In step 180, a decision is made as to whether or not the apparatus received tempo control information TC. If a result of the decision is 'NO', program control returns to the playback process of FIG. 16.

Figure 19:
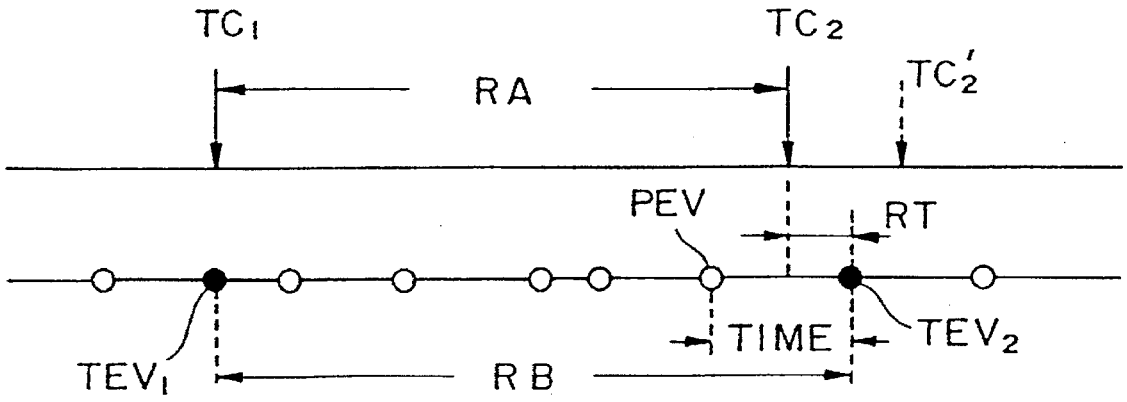
FIG. 19 shows an example of relationship between timings to read or receive data used for calculations of the CPU in the tempo control process.

If a result of the decision of the step 180 is 'YES', the CPU proceeds to step 182 in which a decision is made as to whether or not an event of PAUSE=1 occurs. In other words, a decision is made as to whether or not a reading operation is currently stopped. Herein, a result of the decision of the step 182 turns to 'YES' in an event that a receiving operation of tempo control information TC is delayed behind a reading operation of corresponding tempo control data TEV, i.e., in an event that a swinging speed of the baton is slow. FIG. 19 shows an example of such an event. That is, an event of PAUSE=1 corresponds to the case where at a read timing of the tempo control data $TEV_2$, the apparatus does not receive tempo control information $TC_2'$ corresponding to $TEV_2$. So, the apparatus receives the tempo control information $TC_2'$ after the read timing of the tempo control data $TEV_2$.

On the other hand, a result of the decision of the step 182 turns to 'NO' in an event that a receiving operation of tempo control information TC is made earlier than a reading operation of corresponding tempo control data TEV, i.e., in an event that a swinging speed of the baton is fast. FIG. 19 shows an example of such an event. That is, an event of PAUSE=0 corresponds to the case where at a read timing of tempo control data $TEV_2$, the apparatus has already received tempo control information $TC_2$ corresponding to $TEV_2$.

If a result of the decision of the step 182 is 'YES', the CPU proceeds to step 184 in which a decision is made as to whether or not a keycode 'KC' of the received tempo control information TC coincides with a keycode of a register 'KEY'. If a result of the decision is 'NO', program control returns to the playback process of FIG. 16. If a result of the decision is 'YES', the CPU proceeds to step 186. In other words, a series of steps 186 to 196 following the step 184 is initiated under a condition where the keycode KC of the received tempo control information TC coincides with a keycode of tempo control data TEV which should be read out.

In step 186, the CPU calculates a ratio 'RA/RB' between values of the registers RA and RB, so that the calculated ratio is set to a register 'RATE'. In next step 188, a value of the register TMK is multiplied by a value of the register RATE, so that a result of multiplication is set to the register TMK. As a result, a tempo coefficient TMK is corrected in response to the value of the register RATE. In case of $TEV_2$ and $TC_2'$ shown in FIG. 19, the ration RA/RB should be greater than '1'; and consequently, the tempo coefficient TMK should be made greater than '1'.

In step 190, a limit process is executed on the tempo coefficient TMK. The limit process is used to limit the tempo coefficient TMK not to be greater than a certain value (e.g., 2.0), so that TMK is controlled not to be increased so much.

In step 192, '0' is set to the register RB. In step 194, '0' is set to the register RA. In step 196, '0' is set to the flag PAUSE. Thereafter, program control returns to the playback process of FIG. 16.

Thereafter if the CPU enters into the playback process of FIG. 16 in a next interrupt process so that the value of the register TIME is multiplied by the tempo coefficient TMK in step 146, the value of the register TIME is made larger than its previous value, so that a tempo of automatic performance is made slow to follow a swinging speed of the baton.

Meanwhile, If a result of the decision of the step 182 shown in FIG. 18 is 'NO', the CPU proceeds to step 198 so as to search next tempo control data TEV. Then, the CPU proceeds to step 200.

In step 200, a decision is made as to whether or not the keycode KC of the received tempo control information TC coincides with a keycode of the tempo control data TEV which are searched out by the step 198. This step 200 matches with the aforementioned step 184. If a result of the decision of the step 200 is 'NO', program control returns to the playback process of FIG. 16. If a result of the decision is 'YES', the CPU proceeds to step 202.

In step 202, the CPU calculates an interval of time between a read timing of previous tempo control data and a read timing of the searched tempo control data TEV, so that the calculated interval of time is set to the register RB. This operation will be explained concretely with respect to two cases, as follows:

Suppose a first case shown in FIG. 19 where the CPU receives tempo control information $TC_2$ after reading out event data PEV for sounding/non-sounding control, then, the CPU searches tempo control data $TEV_2$. In this case, the register RB merely stores a numerical value corresponding to an interval of time between a read timing of tempo control data $TEV_1$ and a receiving timing of $TC_2$. This numerical value does not include a numerical value corresponding to an interval of time between the receiving timing of $TC_2$ and a read timing of $TEV_2$. Herein, the read timing of $TEV_2$ does not mean a searching timing of $TEV_2$ but indicates a timing at which the tempo control data $TEV_2$ should be read out in response to a progress of performance. The latter numerical value is identical to a numerical value 'RT' which remains in the register TIME at the receiving timing of $TC_2$, wherein RT becomes equal to zero at the read timing of $TEV_2$. So, the CPU performs addition on the value of the register RB and the value RT of the register TIME, so that a result of the addition is set to the register RB (see step 202).

Figure 20:
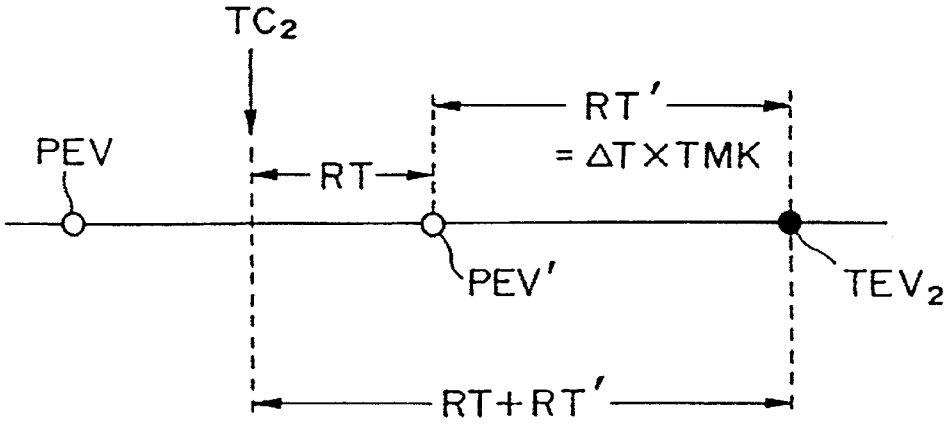
FIG. 20 shows another example of relationship between timings to read or receive data used for calculations of the CPU in the tempo control process.

Suppose a second case shown in FIG. 20 where the CPU receives tempo control information $TC_2$ after reading out event data PEV for sounding/non-sounding control, then, the CPU performs searching operations to read out event data PEV' for sounding/non-sounding control and tempo control data $TEV_2$. In this case, the CPU pays regard to a value RT of the register TIME which may correspond to an interval of time between a receiving timing of $TC_2$ and a read timing of PEV' at which PEV' should be read out in response to a progress of performance. In addition, the CPU pays regard to a numerical value RT' which may correspond to an interval of time between the read timing of PEV' and a read timing of $TEV_2$ at which $TEV_2$ should be read out in response to a progress of performance. The numerical value RT' can be calculated by an equation (2) using a tempo coefficient TMK and an event relative time ΔT, as follows:

$$RT'=\Delta T\times TMK \quad (2)$$

where the event relative time ΔT represents a relative time between events of the data PEV' and $TEV_2$.

So, in the second case, the CPU performs addition on values of the registers RB and TIME, and the numerical value RT', so that a result of the addition is set to the register RB (see step 202 in parenthesis). Incidentally, if multiple event data, each corresponding to PEV', are read out when the CPU searches $TEV_2$, the CPU pays regard to each of the multiple event data like the aforementioned numerical value RT'.

In step 204, a value of the register RB is multiplied by '1/N' so that a result of multiplication is set to the register RB, whilst a value of the register TIME is multiplied by '1/N' so that a result of multiplication is set to the register TIME. Herein, 'N' represents a constant which is adequately selected to make the value of the register RB to be close to the value of the register RA.

In step 206, '1' is set to the flag TCRF. As a result, when the CPU proceeds to step 162 shown in FIG. 17 in a next interrupt process, a result of the decision of the step 162 turns to 'YES', so that '0' is set to the flag TCRF.

In step 208, a ratio between values of the registers RA and RB is set to the register RATE. In next step 210, a value of the register RATE is multiplied by a value of the register TMK, so that a result of multiplication is set to the register TMK. As a result, the tempo coefficient TMK is corrected in response to the value of the register RATE. In an example regarding $TC_2$ and $TEV_2$ shown in FIG. 19, the ratio RA/RB is smaller than '1', so that the tempo coefficient TMK is made smaller than '1'. After completion of the step 210, the CPU proceeds to step 212.

In step 212, the CPU executes a limit process on the tempo coefficient TMK. This limit process is used to limit the tempo coefficient TMK not to be less than a certain value (e.g., 0.5), so that the tempo coefficient TMK is controlled not to be decreased so much.

In step 214, '0' is set to the register RB. In step 216, '0' is set to the register RA. Thereafter, program control returns to the playback process of FIG. 16.

Thereafter, if the CPU enters into the playback process of FIG. 16 in a next interrupt process so that the value of the register TIME is multiplied by the tempo coefficient TMK, the value of the register TIME is made smaller than its previous value. As a result, a tempo of automatic performance is made fast to follow a swinging speed of the baton.

[D] Modification

The invention is not limited to the aforementioned embodiments; hence, it is possible to provide a variety of modification within the scope of the invention. Examples of the modification will be described below with numbers (1) to (18).

(1) The aforementioned embodiments are designed such that motion-kind discrimination (i.e., peak-kind discrimination process) is performed after peak detection. However, it is possible to omit the motion-kind discrimination, so that the device is re-designed to generate tempo control information TC and dynamics control information DC based on a result of the peak detection.

(2) The apparatus is designed such that the fuzzy inference process is used to directly compute a peak and a kind of motion based on a swing motion of the baton. The apparatus can be modified such that the peak and the kind of motion are computed by the conventional method and are then corrected by the fuzzy inference process. In addition, neural network can be further incorporated to the apparatus, so that the neural network is used to determine or correct membership functions, for example.

(3) Sensors for detecting a swing motion of the baton are not limited to the angular velocity sensors such as the piezoelectric-vibration gyro sensors. So, it is possible to employ acceleration sensors or other types of sensors which operate responsive to magnetic property or optical property. Or, it is possible to employ another technology that an image of the baton is picked up so as to detect a swing motion of the baton by the image processing technique. Or, it is possible to employ different kinds of sensors which are combined together to detect a swing motion of the baton.

(4) A number of kinds of motions by which a swing motion of the baton is discriminated is not limited to '3'. So, it is possible to use a more number of motions for discrimination of the swing motion of the baton.

(5) In FIG. 1, the baton is provided independently of the swing-motion analyzing device. However, the swing-motion analyzing device can be built in the baton. In the embodiments shown in FIGS. 1 and 2, the swing-motion analyzing device is provided independently of the electronic musical apparatus having the automatic performance function. However, they can be assembled together into a one-body form. Further, outputs (i.e., information TC and DC) of the swing-motion analyzing device can be supplied to an electronic musical instrument or an automatic performance apparatus, other than the electronic musical apparatus of FIG. 2, so as to carry out performance control.

(6) The baton uses 2 sensors for detecting a swing motion. However, a number of the sensors can be arbitrarily determined. So, it is possible to use 3 sensors for detection of the swing motion. Or, sensors used for detection of a swing motion regarding triple time can differ from sensors used for detection of a swing motion regarding duple time or quadruple time, for example. Outputs of the 3 sensors can be taken into consideration comprehensively to detect a swing motion.

(7) The embodiments are designed to attach the sensors to the baton. The sensors can be attached to other swinging members instead of the baton. Or, the sensors can be attached to a part (or parts) of the human body such as a hand (or hands). The sensors can be built in a microphone or a remote control device used for a certain device such as a karaoke device. Communications between the sensors and the swing-motion analyzing device can be performed by wire or without wire.

(8) The embodiments are designed to control a tempo during progression of performance. Of course, the invention can be applied to the case where the tempo is determined prior to execution of the performance.

(9) The embodiments employ a storing method of performance data by which an event and a delta time (i.e., event relative time) are alternatively stored. It is possible to employ another method by which an event and an absolute time are stored. A milli-second order is used as the unit for storage of the delta time. However, it is possible to use other units such as a unit corresponding to a note length. For example. 1/24 length of a quarter note can be used as the unit for storage of the delta time.

(10) The embodiments performs tempo control such that a value of delta time is multiplied by a tempo coefficient so as to change the delta time. However, the tempo control can be performed by changing a timer-interrupt period of the playback process of FIG. 16. In addition, the tempo control can be performed in such a way that a certain number other than '1' is used as a value which is subtracted from the value of delta time in one timer interrupt. A calculation to change the delta time is not limited the multiplication. So, it is possible to use other calculations such as addition.

(11) Tempo control can be performed by using interpolation by which a tempo is smoothly varied from its previous value to a target value. Control for dynamics can be performed in a similar way to obtain smooth variation of the dynamics.

(12) The embodiments are designed to control a tone volume for performance sound in response to the dynamics control information DC. A parameter (or parameters) which is controlled in response to the dynamics control information DC is not limited to the tone volume for the performance sound. So, it is possible to set other parameters. For example, the information DC is used to control a tone color, a tone pitch and a sound effect of the performance sound. Or, a number of parts in performance is controlled in response to the dynamics control information DC. By controlling some of the above parameters in response to the dynamics control information DC, it is possible to emphasize the dynamics of performance more intensely.

(13) The embodiments can be modified such that the user is capable of editing the fuzzy rules or membership functions. In other words, the electronic musical apparatus can be adjusted in such a way that manipulation becomes easy for the user.

(14) The embodiment uses the fuzzy inference process which is applied to both of detection of a characteristic point of a swing motion and discrimination of a kind of a swing motion. Of course, it is possible to modify the embodiment such that the fuzzy inference process is applied to one of them.

(15) The embodiments are designed to create tempo control information based on an output of peak detection and an output of peak-kind discrimination. Herein, the output of the peak-kind discrimination can be omitted. So, the tempo control information can be created based on the output of the peak detection only.

(16) A method for detection of a peak or a bottom is not limited to the method which is employed by the present embodiments. So, conditions for detection of the peak or bottom can be arbitrarily determined or changed.

(17) The embodiments are designed to control a tone volume and/or a tone color of performance sound in response to musical-tone control information SC. Of course, the musical-tone control information SC can be used to control other parameters. For example, it is possible to control a tone pitch and/or a sound effect of performance sound in response to the information SC; or it is possible to control a number of parts of performance in response to the information SC.

(18) The embodiment uses the neural network which is applied to both of detection of a characteristic point of a swing motion and discrimination of a kind of a swing motion. However, the embodiment can be modified such that the neural network is applied to one of them.

[E] Applicability of the invention

Figure 21:
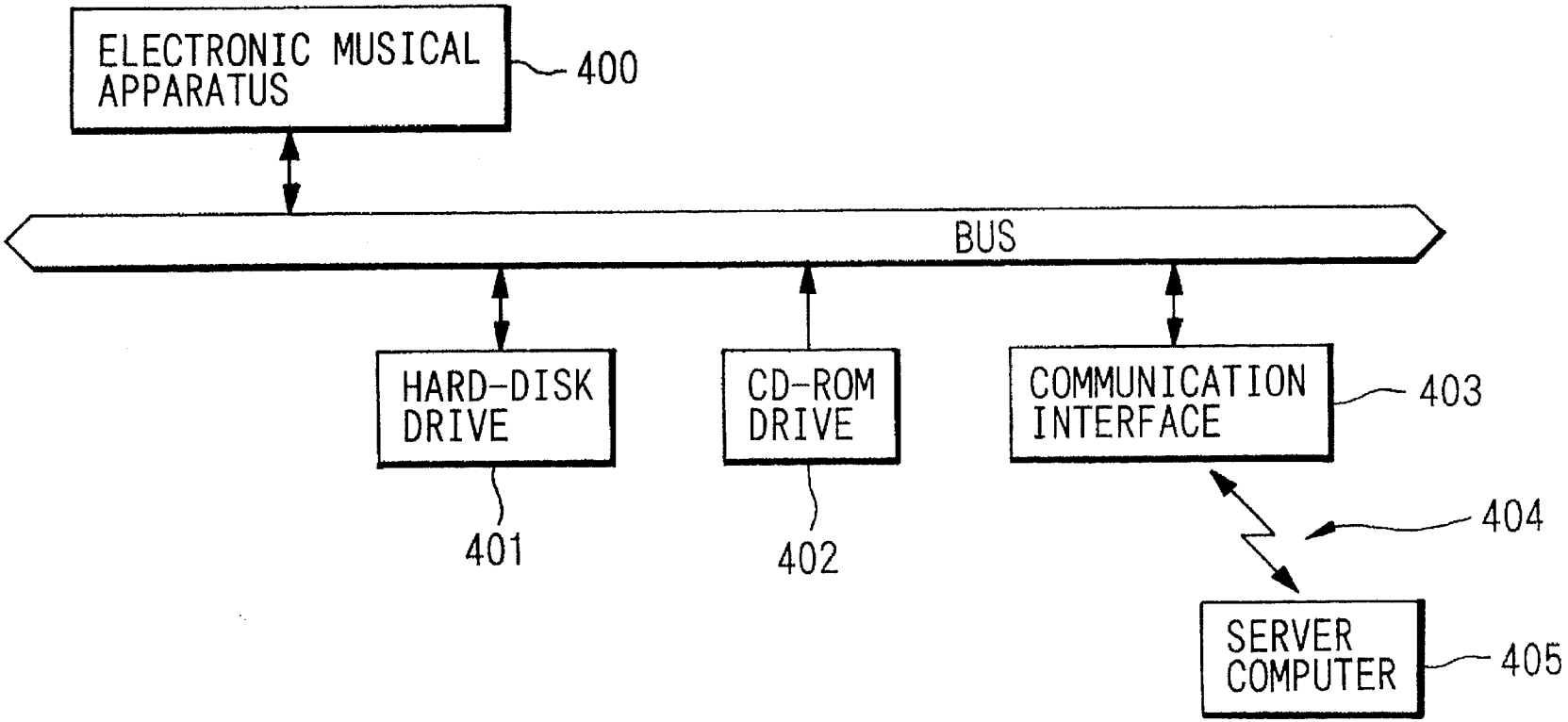
FIG. 21 is a block diagram showing a system which incorporates an electronic musical apparatus which is interconnected with a swing-motion analyzing device in accordance with the invention.

Applicability of the invention can be extended in a variety of manners. For example, FIG. 21 shows a system containing an electronic musical apparatus 400 which corresponds to the aforementioned electronic musical apparatus 50 of FIG. 2 interconnected with the swing-motion analyzing device 10 of FIG. 1 in accordance with the invention. Now, the electronic musical apparatus 400 is connected to a hard-disk drive 401, a CD-ROM drive 402 and a communication interface 403 through a bus. Herein, the hard-disk drive 401 provides a hard disk which stores operation programs as well as a variety of data such as automatic performance data and chord progression data. If a ROM (e.g., ROM 64) of the electronic musical apparatus 400 does not store the operation programs, the hard disk of the hard-disk drive 401 stores the operation programs which are transferred to a RAM (e.g., RAM 66) on demand so that a CPU (e.g., CPU 62) can execute the operation programs. If the hard disk of the hard-disk drive 401 stores the operation programs, it is possible to easily add, change or modify the operation programs to cope with a change of a version of the software.

In addition, the operation programs and a variety of data can be recorded in a CD-ROM, so that they are read out from the CD-ROM by the CD-ROM drive 402 and are stored in the hard disk of the hard-disk drive 401. Other than the CD-ROM drive 402, it is possible to employ any kinds of external storage devices such as a floppy-disk drive and a magneto-optic drive (i.e., MO drive).

The communication interface 403 is connected to a communication network such as a local area network (i.e., LAN), a computer network such as 'internet' or telephone lines. The communication network 403 also connects with a server computer 405. So, programs and data can be downloaded to the electronic musical apparatus 400 from the server computer 405. Herein, the system issues commands to request 'download' of the programs and data from the server computer 405; thereafter, the programs and data are transferred to the system and are stored in the hard disk of the hard-disk drive 401.

Moreover, the present invention can be realized by a 'general' personal computer which installs the operation programs and a variety of data which accomplish functions of the invention such as functions to analyze the swing motion of the baton in accordance the fuzzy inference process or neural network. In such a case, it is possible to provide a user with the operation programs and data prestored in a storage medium such as a CD-ROM and floppy disks which can be accessed by the personal computer. If the personal computer is connected to the communication network, it is possible to provide a user with the operation programs and data which are transferred to the personal computer through the communication network.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. A performance control apparatus comprising:

sensor means for sensing a swing motion made by a human operator;

detection means for detecting a characteristic point of the swing motion based on an output of the sensor means, wherein the characteristic point of the swing motion is detected using a fuzzy inference process; and performance control means for controlling a manner of performance based on an output of the detection means.

2. A performance control apparatus comprising:

sensor means for sensing a swing motion made by a human operator;

detection means for detecting a characteristic point of the swing motion based on an output of the sensor means;

discrimination means for discriminating a kind of the swing motion based on the output of the sensor means as well as an output of the detection means, wherein the kind of the swing motion is discriminated using a fuzzy inference process; and performance control means for controlling a manner of performance based on an output of the discrimination means.

3. A performance control apparatus comprising:

sensor means for sensing a swing motion made by a human operator;

detection means for detecting a characteristic point of the swing motion based on an output of the sensor means, wherein the characteristic point of the swing motion is detected using a neural network; and performance control means for controlling a manner of performance based on an output of the detection means.

4. A performance control apparatus comprising:

sensor means for sensing a swing motion made by a human operator;

detection means for detecting a characteristic point of the swing motion based on an output of the sensor means;

discrimination means for discriminating a kind of the swing motion based on the output of the sensor means, wherein the kind of the swing motion is discriminated using a neural network;

performance control information creating means for creating performance control information based on an output of the detection means as well as an output of the discrimination means; and performance control means for controlling a manner of performance based on the performance control information.

5. A performance control apparatus comprising:

sensor means for sensing a swing motion of a baton which is swung by a human operator to conduct music;

fuzzy analysis means for analyzing the swing motion of the baton based on an output of the sensor means so as to create performance control information in accordance with a fuzzy inference process, wherein the fuzzy inference process uses a plurality of fuzzy rules to discriminate a kind of the swing motion, so that the performance control information is created in response to the discriminated kind of the swing motion; and performance control means for controlling performance of the music based on the performance control information.

6. A performance control apparatus according to claim 5 wherein the sensor means is constructed by a plurality of angular velocity sensors which are attached to the baton.

7. A performance control apparatus according to claim 5 further comprising peak detection means which detects a peak of the output of the sensor means, so that the fuzzy analysis means analyzes the peak to create the performance control information in accordance with the fuzzy inference process.

8. A performance control apparatus according to claim 5 wherein the performance control means controls a tempo of the performance.

9. A performance control apparatus according to claim 5 wherein the swing motion is classified to one of predetermined motions which are determined specifically with respect to time of the music, so that the performance control information is created based on one of the predetermined motions which meets the swing motion currently made by the human operator.

10. A performance control apparatus comprising:

sensor means for sensing a swing motion of a baton which is swung by a human operator to conduct music;

neural analysis means for analyzing the swing motion of the baton based on an output of the sensor means so as to create performance control information in accordance with a neural network, wherein a structure of the neural network is determined in advance to calculate probabilities with respect to the swing motion so that a kind of the swing motion is discriminated, and the performance control information is created in response to the discriminated kind of the swing motion; and performance control means for controlling performance of the music based on the performance control information.

11. A performance control apparatus according to claim 10 wherein the sensor means is constructed by a plurality of angular velocity sensors which are attached to the baton.

12. A performance control apparatus according to claim 10 further comprising peak detection means which detects a peak of the output of the sensor means, so that the neural analysis means analyzes the peak to create the performance control information in accordance with the neural network.

13. A performance control apparatus according to claim 10 wherein the performance control means controls a tempo of the performance.

14. A performance control apparatus according to claim 10 wherein the swing motion is classified to one of predetermined motions which are determined specifically with respect to time of the music, so that the performance control information is created based on one of the predetermined motions which meets the swing motion currently made by the human operator.

15. A storage device storing programs and parameters which cause an electronic musical apparatus to execute a performance control method comprising the steps of:

reading an output of sensor means which senses a swing motion of a baton which is swung by a human operator to conduct music;

detecting a peak of the output of the sensor means in accordance with a peak detection process using a fuzzy inference process;

discriminating a kind of the swing motion by effecting a fuzzy inference process on a result of the peak detection process;

creating performance control information based on the discriminated kind of the swing motion; and controlling performance of the music based on the performance control information.

16. A storage device storing programs and parameters which cause an electronic musical apparatus to execute a performance control method comprising the steps of:

reading an output of sensor means which senses a swing motion of a baton which is swung by a human operator to conduct music;

detecting a peak of the output of the sensor means in accordance with a peak detection process using a neural network, wherein a structure of the neural network is determined in advance to calculate probabilities with respect to the swing motion;

discriminating a kind of the swing motion under consideration of the probabilities calculated by the neural network;

creating performance control information based on the discriminated kind of the swing motion; and controlling performance of the music based on the performance control information.

* * * * *